US008887648B2

(12) United States Patent
Brutter et al.

(10) Patent No.: US 8,887,648 B2
(45) Date of Patent: Nov. 18, 2014

(54) IMPACT RESISTANT STRUCTURE

(75) Inventors: Arthur Brutter, Ness Ziona (IL); Ido Bruno, Jerusalem (IL)

(73) Assignee: A.D. Meraz Industries Ltd., Sderot (IL)

( * ) Notice: Subject to any disclaimer, the term of this patent is extended or adjusted under 35 U.S.C. 154(b) by 0 days.

(21) Appl. No.: 13/805,995

(22) PCT Filed: Jun. 21, 2011

(86) PCT No.: PCT/IL2011/000494

§ 371 (c)(1),
(2), (4) Date: Dec. 20, 2012

(87) PCT Pub. No.: WO2011/161677

PCT Pub. Date: Dec. 29, 2011

(65) Prior Publication Data

US 2013/0092059 A1 Apr. 18, 2013

Related U.S. Application Data

(60) Provisional application No. 61/356,696, filed on Jun. 21, 2010, provisional application No. 61/468,449, filed on Mar. 28, 2011.

(51) Int. Cl.

| | |
|---|---|
| ***A47B 13/00*** | (2006.01) |
| ***E04H 9/02*** | (2006.01) |
| ***A47B 13/02*** | (2006.01) |

(52) U.S. Cl.

CPC . *A47B 13/02* (2013.01); *E04H 9/02* (2013.01)
USPC ..... 108/161

(58) Field of Classification Search

USPC ..... 108/147, 11, 50.11, 57.12, 150, 161; 248/188.1

See application file for complete search history.

(56) References Cited

U.S. PATENT DOCUMENTS 5,829,366 A 11/1998 Uono
5,960,904 A * 10/1999 Ullmann ..... 182/45

FOREIGN PATENT DOCUMENTS

| | | |
|---|---|---|
| CN | 201275377 | 7/2009 |
| DE | 2902322 | 7/1980 |
| JP | 9032342 | 2/1997 |
| JP | 3233822 | * 12/2001 |

OTHER PUBLICATIONS

Copp, Doug; Doug Copp's Blog; "You only need to know two words, to understand, how to live or die in an quake", posted Nov. 5, 2012. (4 pages).

International Search Report from International Application No. PCT/IL2011/000494 mailed Nov. 30, 2011.

* cited by examiner

*Primary Examiner* — Matthew Ing
(74) *Attorney, Agent, or Firm* — Dorsey & Whitney LLP

(57) ABSTRACT

The present subject matter is directed towards impact resistant structures. The structures comprise a support truss having at least two side frames, each comprising at least two vertical members connected at the upper end thereof with a horizontal member. The support truss further comprises a rear frame comprising at least one vertical frame post extending above a height of the vertical members. The structures also have a load-bearing assembly comprising at least one vertical load-bearing post spaced apart from the frame post, at least one horizontal load-bearing beam extending at least between the at least one vertical load-bearing post and the frame post; and at least two inclined load-bearing beams substantially extending from the at least one horizontal load-bearing beam to the at least two side frames.

17 Claims, 23 Drawing Sheets

IMPACT RESISTANT STRUCTURE

FIELD OF THE PRESENTLY DISCLOSED SUBJECT MATTER

This invention relates to impact resistant structures. More particularly the invention is concerned with a functional element, such as a furniture article having a regular functional use, and on the other hand serving as an impact resistant structure suited for bearing high impacts and loads, rendering it suitable for use as a temporary shelter e.g. in the case of earth quakes, hostile attacks.

BACKGROUND

It has been recently recognized that during disasters such as earthquakes, terrorist bombing attacks, volumous falling debris e.g. during the collapse of multi-storey buildings, such as ceiling, walls etc., survivable voids, typically, triangular spaces, are seen throughout the scene which are formed around the objects in the disaster/blast struck areas. It has become recognized that such triangular spaces are safe spaces, namely being trapped in such a space would prevent injury and save the lives of those trapped. As such, the triangular spaces came to be known as the "triangle of life".

One of the deadliest places to be trapped under during a disaster is under a desk or a table. The legs of the desk would snap when the ceiling falls thereon. Typically the ceiling will not shatter when falling and will thus fall in very large chunks. In the event that the ceiling breaks and only partially collapses, or any other falling debris impacts the table top, as seen in the prior art FIG. 20 (taken from http://dougcopp.wordpress.com/page/2 last accessed on Jun. 20, 2011), table top will snap under the weight of the falling debris forming the triangle of life on the sides of the table posts.

One solution to the problem is proposed in the utility model CN201275377Y. CN201275377 describing a multipurpose device for taking refuge from disasters, which comprises a base, a protection surface and a rotatable moving plane, which are sequentially connected with each other to form an accommodating space with a triangular cross section, wherein, a location device is arranged between the moving plane and the protection surface for fixing the opening angle. The multipurpose device has the advantages of simple structure and convenient use, and can be used as common furniture in daily normal state by opening the moving plane to a proper angle or used as a place for taking refuge in the triangular space with the most stable structure. The weight bearing capability and the impact resistance of the bevel surface of the triangular space are greatly higher than those of a horizontal bearing surface of the prior furniture, thereby greatly improving the opportunity for living in disasters. The multipurpose device can be widely used in furniture such as table, chair, bed, and cabinet.

SUMMARY OF THE PRESENTLY DISCLOSED SUBJECT MATTER

The presently disclosed subject matter is concerned with impact-resistant structures comprising a cage-like reinforced support truss configured to bear substantially vertical loads, a substantially central load-bearing assembly extending above said support truss and configured to bear loads.

The impact resistant structure may further be provided with a top surface fixed over said load-bearing element at a substantially horizontal configuration. In accordance with an embodiment of the invention, the support truss is configured to bear loads at various impact angles, e.g. substantially vertical loads, loads falling at an angle to the cage-like reinforced support truss etc.

The arrangement being such that at normal, daily use of the device it is used as a functional article, e.g. a school table, office desk, dining table, book shelf, bed, sofa and the like. However, at the event of earthquake or a blast attack the device may be used as a temporary shelter.

The structure of the device is such that at the event of impact applied thereto, such as from above (i.e. falling of building debris and the like), the cage-like reinforced support truss and the central load-bearing element are configured to withstand the load (e.g. vertical load) applied thereto, whilst the top surface is supported in a configuration availing it to collapse downwards from the central load-bearing element towards any one or both side edges thereof, thus giving rise to a safe space extending below the structure, referred to in the art as a 'triangle of life'.

The sideward collapsing top surface, whilst being supported from below to prevent it from collapsing into the safe space, deforms into a substantially sloped roof portion of the structure, such that debris will likely slide off the surface.

The top surface, according to different applications of the disclosed subject matter, may be supported from bellow by one or more support elements, or a support frame, reinforcing the surface and dividing it into safe segments, however configured to collapse or deform upon applying thereon an impact, such as vertically extending impact, thereby absorbing some of the impact energy whilst assuring collapsing of the top surface as indicated herein.

In accordance with an aspect of the presently disclosed subject matter, the impact resistant structure comprises a support truss comprising at least two side frames, each comprising at least two vertical members connected at the upper end thereof with a horizontal member; and a rear frame comprising at least one vertical frame post extending above a height of the vertical members. The structure further comprises a load-bearing assembly having at least one vertical load-bearing post spaced apart from the frame post, at least one horizontal load-bearing beam extending at least between the at least one vertical load-bearing post and said frame post; and at least two inclined load-bearing beams substantially extending from the at least one horizontal load-bearing beam to the at least two side frames.

In accordance with another aspect the presently disclosed subject matter is directed to a desk. The desk comprises a support truss comprising at least two side frames, each comprising at least two vertical members connected at the upper end thereof with a horizontal member; and a rear frame comprising at least one vertical frame post extending above a height of the vertical members. The structure further comprises a load-bearing assembly having at least one vertical load-bearing post spaced apart from the frame post, at least one horizontal load-bearing beam extending at least between the at least one vertical load-bearing post and said frame post; and at least two inclined load-bearing beams substantially extending from the at least one horizontal load-bearing beam to the at least two side frames and a table top mounted over the structure.

In accordance with yet another aspect, the presently disclosed subject matter is directed to an impact resistant structure comprising a rear frame comprising at least one vertical frame post; at least one vertical load-bearing post spaced apart from the vertical frame post; at least one horizontal load-bearing beam extending at least between the at least one vertical load-bearing post and said frame post; and at least two inclined load-bearing beams substantially extending sideways from the at least one horizontal load-bearing beam. In accordance with this aspect, the structure may be fitted in a space provided with at least two sidewalls. The at least two inclined load-bearing beams may substantially extend sideways from the at least one horizontal load-bearing beam to the sidewalls and connected thereto.

The structures in accordance with the disclosed subject matter may comprise any one or more of the following features:

- the at least two side frames are further interconnected by a rear beam connecting two of the vertical members on each of the at least two side frames through the vertical frame post;
- the at least one horizontal load-bearing beam extends centrally between the at least two side frames;
- at least one vertical load-bearing post is centered with respect to the length of said at least one horizontal load-bearing beam;
- at least one vertical load-bearing post off centered with respect to the length of said at least one horizontal load-bearing beam;
- at least one vertical load-bearing post is positioned approximately ¾ of the length of said at least one horizontal load-bearing beam;
- a horizontal support frame mounted over the structure;
- the support frame is configured to support a top surface;
- the top surface is configured to function as a table top;
- the at least two inclined load-bearing beams extend substantially centrally from the at least one horizontal load-bearing beam to the at least two side frames;
- four inclined load-bearing beams, two of the inclined beams extending from the rear post to the side frames and two from the at least one horizontal load-bearing beam to the at least two side frames;
- a planar support frame extending on the sides of the horizontal support beam;
- impact absorbing members at the top ends of the at least two side members.
- the impact absorbing members are configured to support the planar support frame;
- the impact absorbing members are configured for plastic deformation, elastic deformation and the like;
- the impact absorbing members are shock absorbing support elements, configured for absorbing at least some of the shock caused when a weighted mass falls on the structure causing it to collapse; and
- the shock absorbing support elements are in a form of a piston.

In accordance with an example of the presently disclosed subject matter, the structure is be configured with energy and or shock absorbing support elements (SASE). For example such elements can be configured at the corners of the truss structure, extending between the top surface and the support truss. In accordance with one example, the SASE are configured so as to extend between the side frames, e.g. vertical bars, and the top surface and/or its support frame. The SASE may be any type of element configured to absorb impact energy and/or shock and deformation/displacement. Such a SASE may for example be a piston, e.g. mechanical, pneumatic or hydraulic piston.

In accordance with yet an example, the SASE is a plastically deformable element to thus facilitate impact absorbing by plastic deformation thereof.

In accordance with yet example, the SASE is an elastically deformable element to thus facilitate impact absorbing by elastic deformation thereof.

The SASE is configured to provide stability to the top surface under an intended, normal use of the table, and to absorb momentum caused by the impact forces inflicted to the structure and in particular, the table top surface, e.g. by weighty loads falling thereon.

In accordance with yet an example, one or more of the vertical bars is configured with pads to minimize movement of the structure upon impact. The pads may be made of any type of flexible material, such as silicone, plastic, neoprene, rubber, wood, etc. The structure and frame elements are designed according to engineering standards so as to bear intended loads. For example, profiles of the structure may be selected from circular, rectangular, I-like, L-like, H-like shaped profiles, of appropriate moment of inertia. Likewise, the top surface may be made of wood, plastic material, reinforced material etc. The support truss may be made of any type of material, configured to withstand loads higher in weight than can be withstood by the top surface, for example. Such materials may be metal, plastic, wood, reinforced materials and any combinations thereof.

The disclosed subject matter is concerned with a functional structure, such as a school table, office desk, dining table, book shelf, bed, sofa or the like.

When provided in an institute, e.g. a school, office, and the like, the structures may be arranged adjacent to one another so as to form a large shelter space capable of sheltering several individuals, and more so, the structures may extend along a rescue-path leading towards an escape exit of the room.

According to a modification of the presently disclosed subject matter, for practical purposes, the safe space is devoid of a front central support leg. According to yet an example, the front support leg is configured for displacement relative to the center of the structure or detachable attachment respective to the truss structure.

Also, a light emitting substance may be applied to portions of the structure, and rescue and survival equipment may be stored at the safe space, e.g. supply of food, water, oxygen, first aid, signaling/communication equipment, and the like. Such equipment may be a priory stored at the structure or fitted thereto upon demand.

BRIEF DESCRIPTION OF THE DRAWINGS

In order to understand the invention and to see how it may be carried out in practice, embodiments will now be described, by way of non-limiting examples only, with reference to the accompanying drawings, in which:

in FIG. 16A) matter with two individuals fitted within the safe space prior to impact;

DETAILED DESCRIPTION OF SPECIFIC EXAMPLES

Figure 1A:
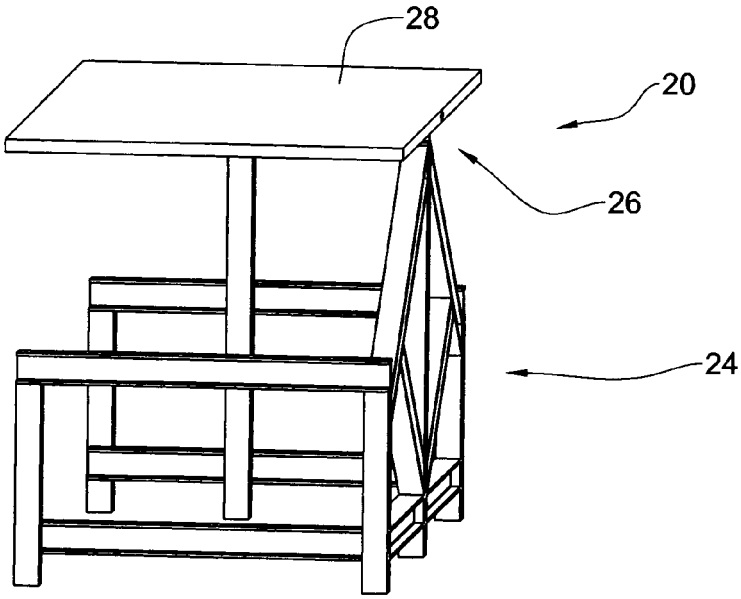
FIG. 1A is a side perspective view of a table in accordance with one configuration of a disclosed subject matter.

Attention is first directed to FIGS. 1A to 1D illustrating a desk generally designated 20 e.g. a school table, office desk, and the like, in the present case suited for comfortably serving two persons, e.g. two students. The table 20 comprises a cage like reinforced support truss generally designated 24, a central load-bearing assembly 26 and a substantially vertically extending table top 28 supported over the load-bearing assembly 26, as will be discussed hereinafter.

The support truss 24 is composed of two side frames 36, a rear frame 38 and has an open front at 40. The side frames 36 each comprise a pair of vertically extending bars 44 having a square section and being interconnected by a pair of I-like side beams 48A and 48B and rear beams 50A, 50B and 50C.

The side frames 36 together with the rear frame 38 constitute a rigid cage-like support truss configured for bearing significantly high loads applied in a vertical direction and define together a safe space referred to at 60 to be discussed hereinafter in further detail.

The central load-bearing assembly 26 comprises a rear post 70 coextending within the rear frame 38 and extending above the level of side frames 36. Together with a central post 72 it supports a horizontal central load-bearing bar 76 upon which the top surface 28 is fixedly mounted.

It is appreciated that beams 70 and 72 are reinforced beams configured for bearing significant vertical loads and likewise, the central load-bearing beam 76 is an I-like beam having a high moment of inertia and thus configured to bear significant loads as well and resist significant impact applied thereto from above.

It is appreciated that the height h of the table top 28 corresponds with typical human engineering standards and in the case of a school table would be approximately 90 cm.

It is noted that the front face 40 of the table is clear of any support elements and further, the rear frame 24 has two top downwardly extending frame members 50B sloping from the top of beam 70 towards the upper end of the rear bars 44.

The top surface 28 may be standard plywood or any other table top surface, e.g. plastic material, recycled plastic or other material or any other suitable material, with or without a frame or support elements extending, typically below. Likewise, the table top 28 may be reinforced by a grid of material of (not shown).

Figure 2:
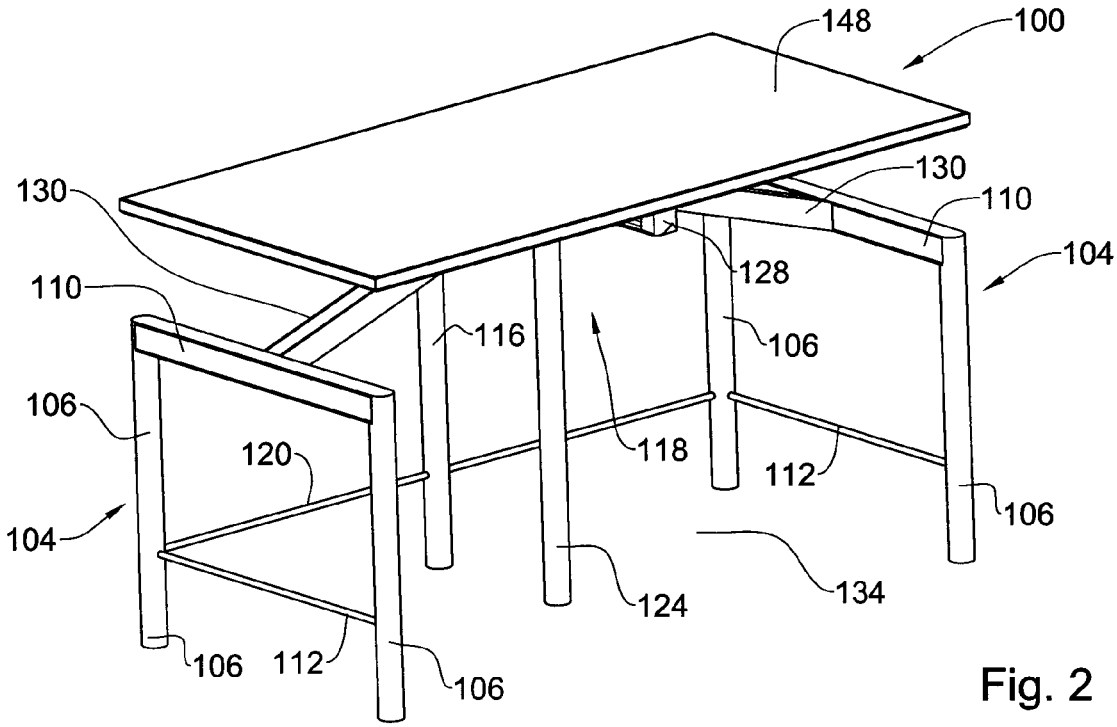
FIG. 2 is a perspective view of a table in accordance with a different configuration of a table subject of the present application.

Turning now to FIG. 2 there is illustrated a table 100 configured similarly to table 20 of the previous example, however with a less sturdy appearance, though it is well appreciated that the side frames 104 are configured for bearing significant vertical loads owing to the side legs 106 having a circular cross-section and being of increased moment of inertia, interconnected by a rectangle cross-bar 110 also of significant moment of inertia and further by a lower cross bar 112 which may be of lesser strength. Likewise, the rear frame comprises a rear support post 116 (in fact constituting part of the central load-bearing assembly 118) wherein the rear frame elements (namely posts 106, and 116) are interconnected by a lower bar 120. The central load-bearing assembly 118 is composed of the rear post 116, a central post 124, both configured for bearing significant vertical loads impact and typically have a circular cross section thus being of increased moment of inertial and are interconnected by a horizontally extending beam 128 having an I-like cross section (best seen in FIG. 3). Extending from the top end of the central post 124 towards the interconnecting beam 110 of the side frames 104 there is an inclined support beam 130 (seen also in FIG. 3) which on the one hand imparts rigidity to the cage-like support truss, and the safe space 134 defined thereby and on the other hand, and as will be discussed hereinafter in further detail, provides an inclined support for the table top to bear upon at the event of collapse under load.

Figure 3:
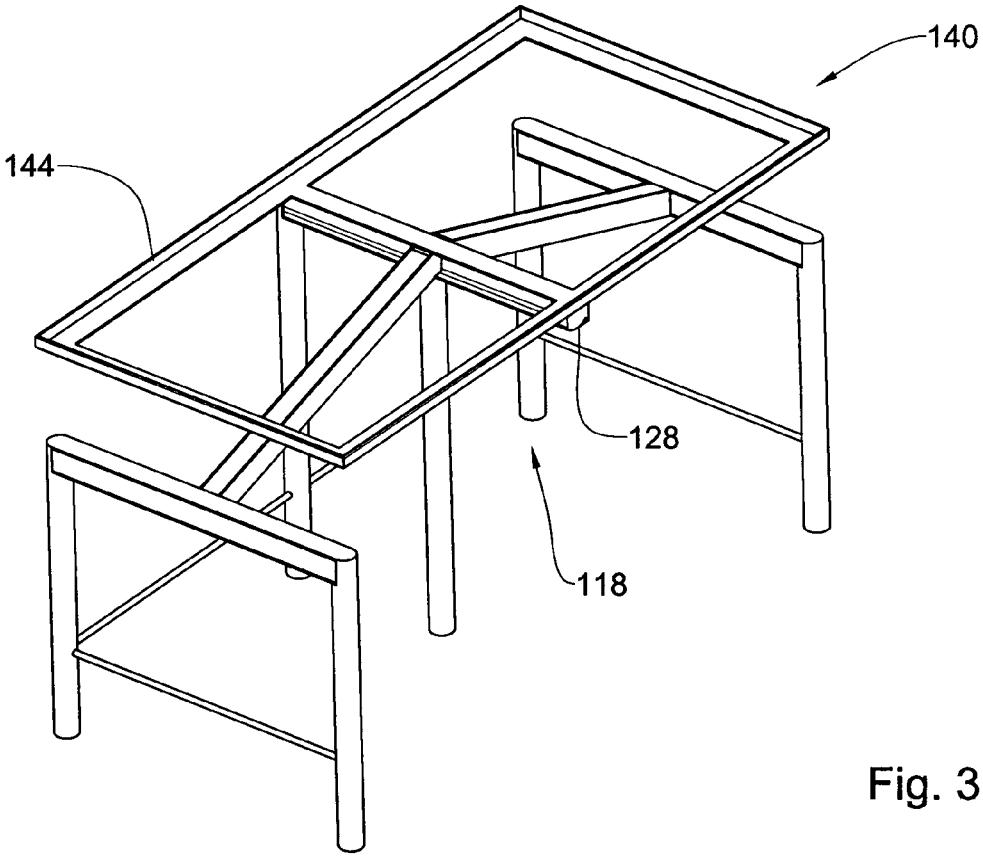
FIG. 3 is a frame structure devoid of a top surface, of a structure according to an example of the present subject matter.

FIG. 3 illustrates a table 140 being extremely similar to that disclosed in FIG. 2 however with a support frame 144 supporting and reinforcing a table top to be mounted thereupon (not illustrated in FIG. 3, illustrated in FIG. 2 and designated 148).

It is further noted that the table 140 in FIG. 3 is devoid of lower cross bars 112 and 120 provided in the table of FIG. 2.

Figure 4A:
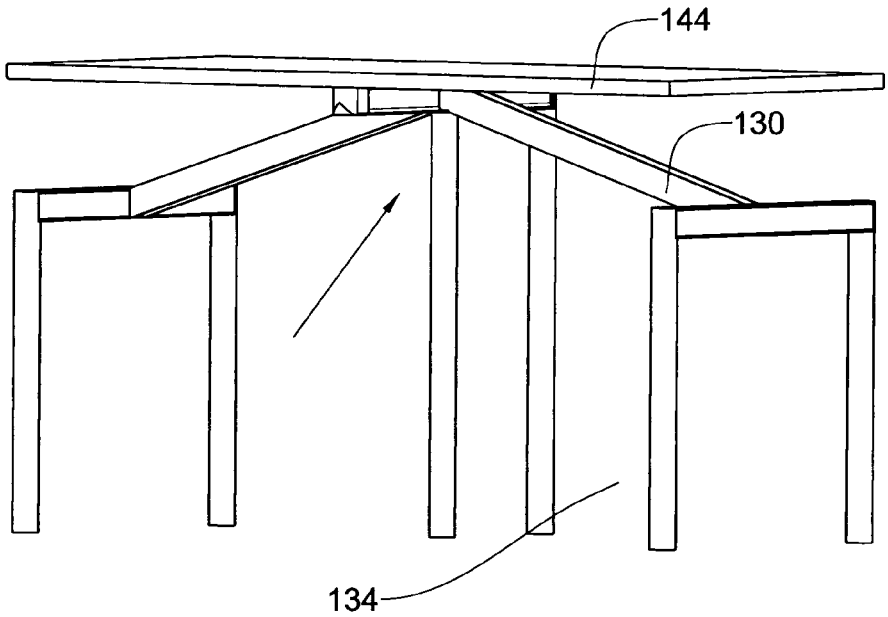
FIGS. 4A and 4B are a perspective and front view, respectively, of yet another table subject of the present application.
Figure 4B:
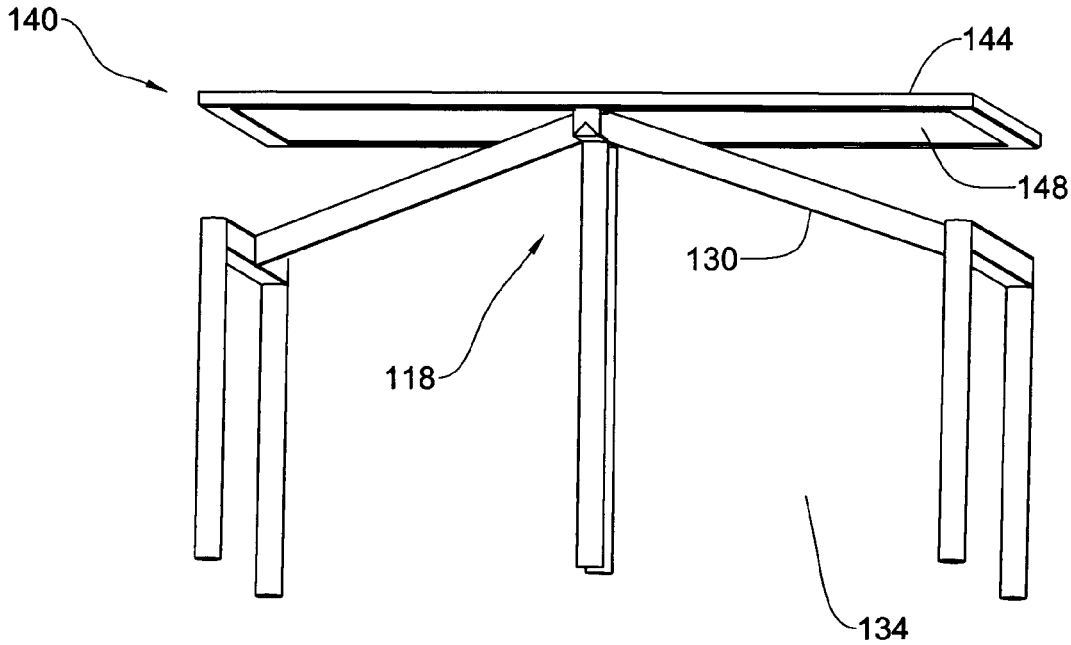

FIGS. 4A and 4B illustrate the table of FIG. 3, with the table top 148 mounted and fixedly supported over the central load-bearing assembly 118 with the safe space 134 extending below the top surface 148 and the inclined beams 130, however being easily accessible from either the front side of the table or from any of its side or rear frames.

Figure 5:
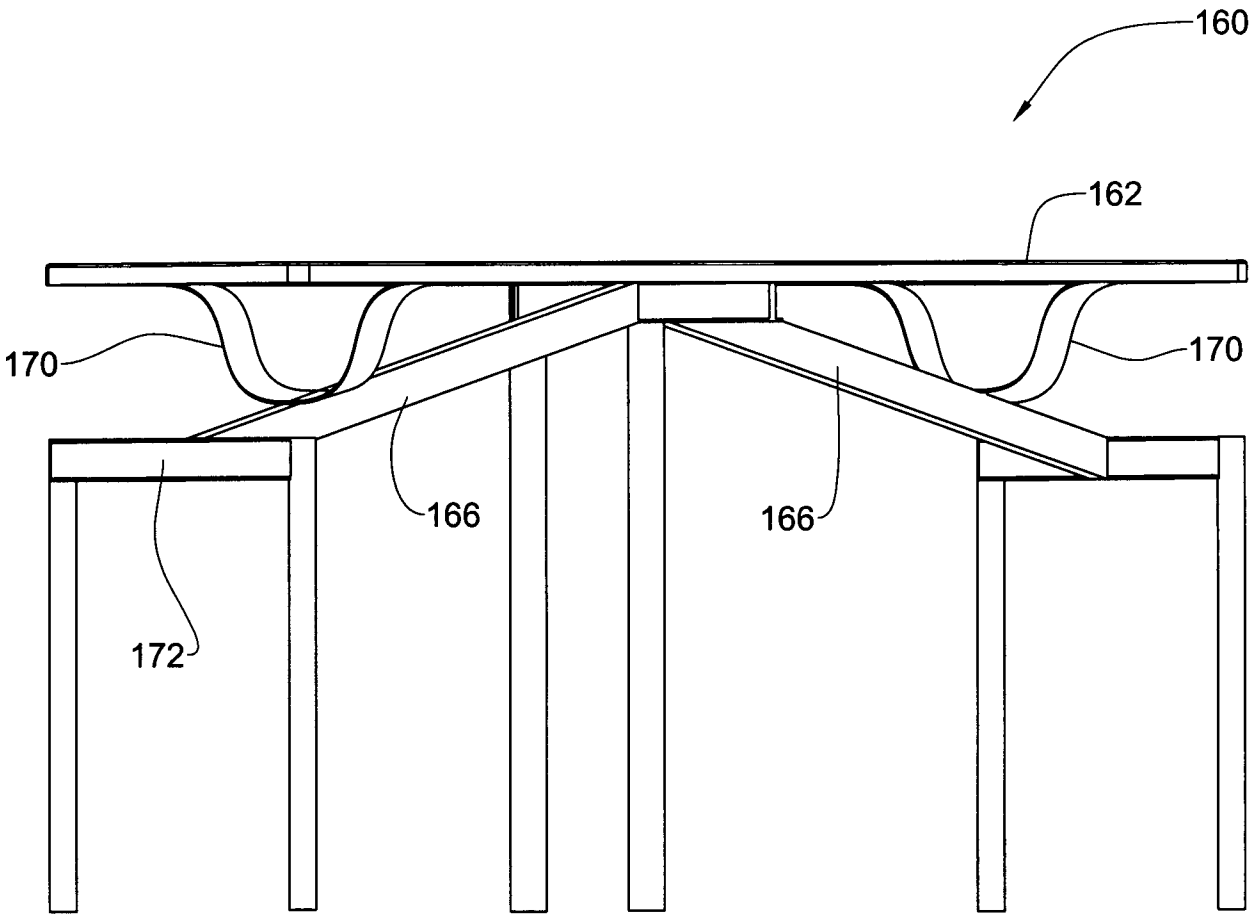
FIG. 5A is a perspective view of a modification of a table subject of the present application.

In the example of FIG. 5 there is illustrated a table 160 resembling table 140 of the previous drawings however, the table top 162 is further supported over the inclined beams 166 by a pair of deformable support elements 170 designed such that an impact vertically applied over the table top surface 162 will result in deformation of the support elements 172 thus dampening the impact and facilitating collapsing of the table top 162 to bear over the inclined support beams 166 and over the horizontally extending interconnecting side bars 172 of the side frames.

The support element 170 is illustrated in the form of a substantially flat piece of material (e.g. metal) to thus facilitate impact absorbing by plastic deformation thereof.

Figure 6A:
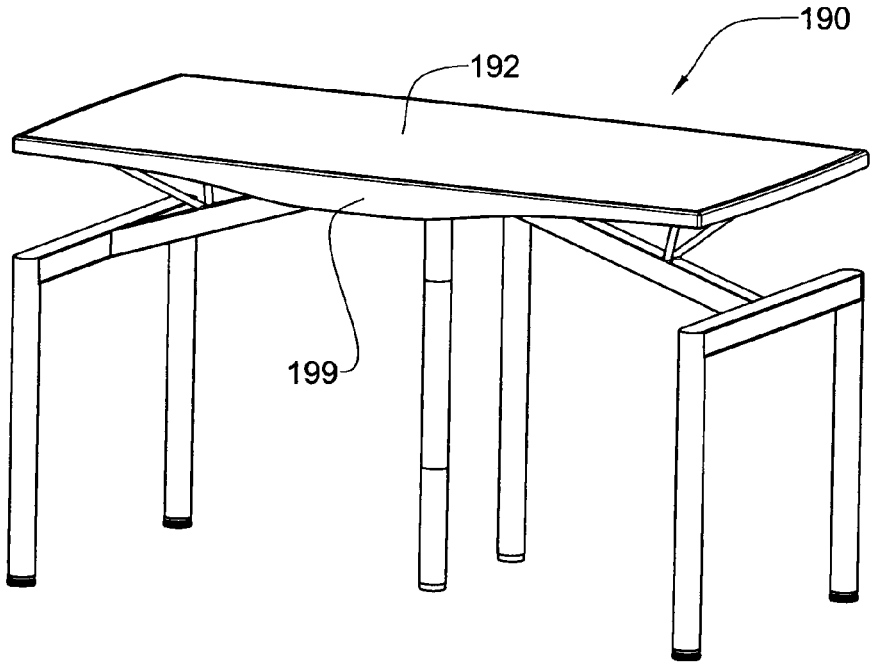
FIGS. 6A and 6B are a perspective top and bottom view, respectively of a different example of a table subject of the present application.
Figure 6B:
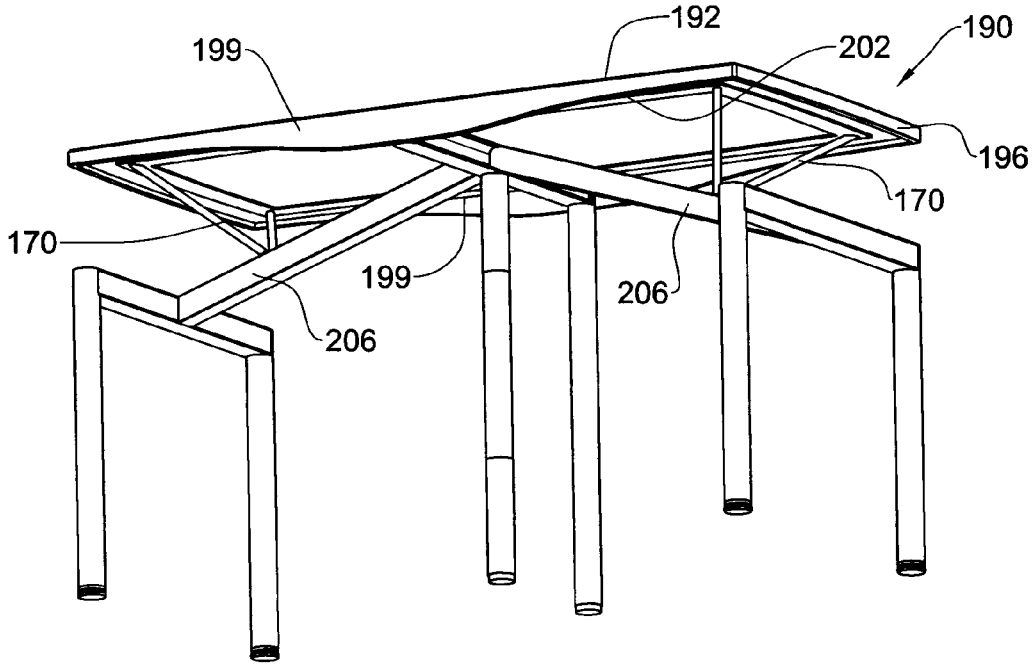

The example illustrated in FIGS. 6A and 6B is substantially similar to the table 160 of FIG. 5 with several differences. For example, the table 190 in FIGS. 6A and 6B illustrates a table top 192 configured along its side with a downwardly extending skirt 196 thus increasing the moment of inertia of the table top 192. Further, rigidity of the table top is increased by a reinforced skirt portion 199 at the central front and rear segments of the table top further adding to rigidity thereof.

Yet another difference resides in that the table top 192 is supported from below by a rectangle frame 202 extending adjacent a perimeter of the table top, and wherein a pair of support elements 170 extend from the frame 202 towards the inclined support beams 206. It is noted that the support elements 170 are of reduced section and are thus designed for collapse under load thereby absorbing energy upon their plastic deformation at the event of impact/load applied over the table top 190.

Figure 7:
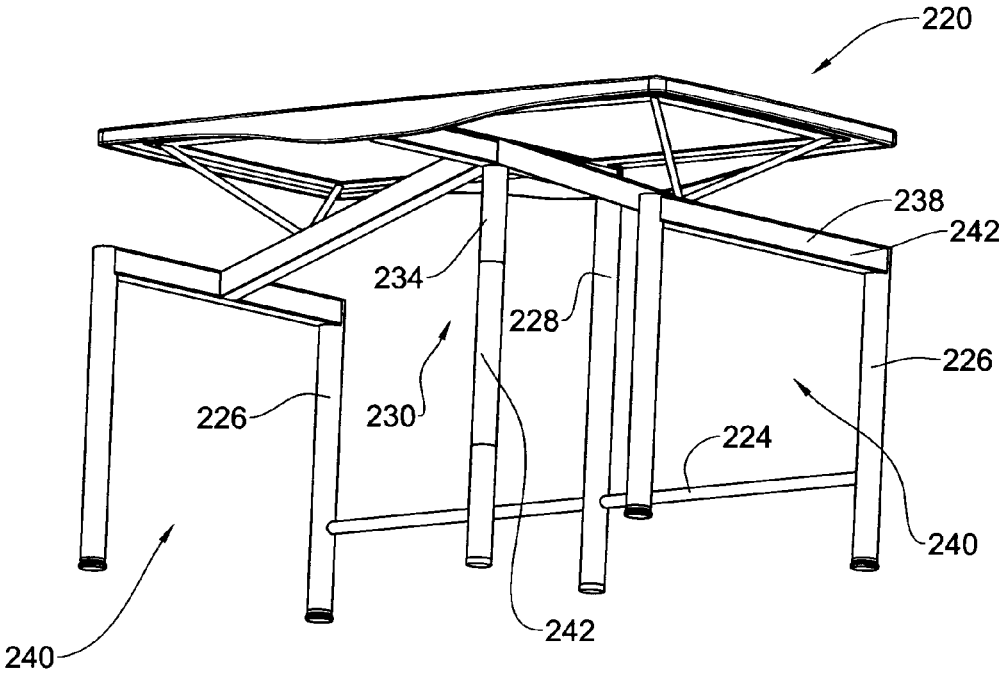
FIG. 7 illustrates a bottom perspective view of a table similar to that disclosed in FIGS. 6A and 6B, however fitted with a light-emitting substance.

In the example of FIG. 7 table 220 illustrates a construction similar to that disclosed in connection with table 190 of FIGS. 6A and 6B however with the addition of a rear cross bar 224 extending from the rear bars 226 of the table towards the central support beam 228 of the load-bearing assembly 230.

Furthermore, it is illustrated that the central support beam 234 and the top beam 238 of the side frames 240 are applied with a light-reflecting/emitting segment 242 thus increasing visibility of the safe space at the event of darkness.

Figure 8:
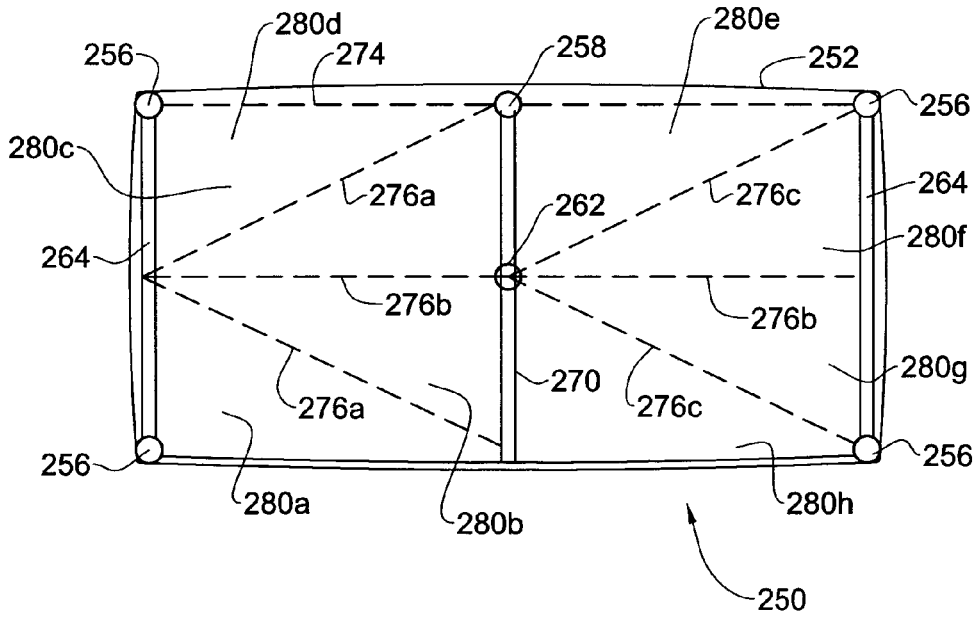
FIG. 8 is a top planar view of a surface of a structure according to the present disclosure, schematically illustrating division into safe sections of the top surface.

Further reference being now made to FIG. 8 there is a schematic top planar view of a table top generally designated 250 wherein the contour line of the table top is illustrated by a solid line 252 and wherein vertically load-bearing support beams, essential to the system are designated by thick circular solid lines disposed at respective corners of the table top designated 256, and a central support beam 258 constituting part of a central load-bearing assembly together with a central support 262 also represented by a thick solid circle. Support beams of the system essential for reinforcement of the cage-like support truss are represented by thick solid lines and designated 264 and the central table top support bar, horizontally extending is also designated by a thick solid line and designated 270. Optional reinforcing bars may extend at the perimeter of the cage-like reinforced support truss represented by dashed thick lines 274 (however not extending at the front of the table so as to prevent an obstacle) and further, the table top may be supported over an array of support bars extending between any of the support posts 256, 258 and 262 as represented by dashed lines those supporting the table top from below and/or extending from the central bar 270 and inclining downwards towards the support frame 264 to thereby support the table top upon its collapsing. It is appreciated that any configuration of support beams 276A, 276B and 276C may be provided for dividing the area of the table top into respective segments designated 280A through 28011, respectively, the size of each such segment being sufficiently small to prevent falling objects such as debris and the like from penetrating through the table top board and injuring one or more individuals seeking shelter within the safe space defined by the cage-like support truss, the load-bearing assembly, and the top surface.

Figure 9A:
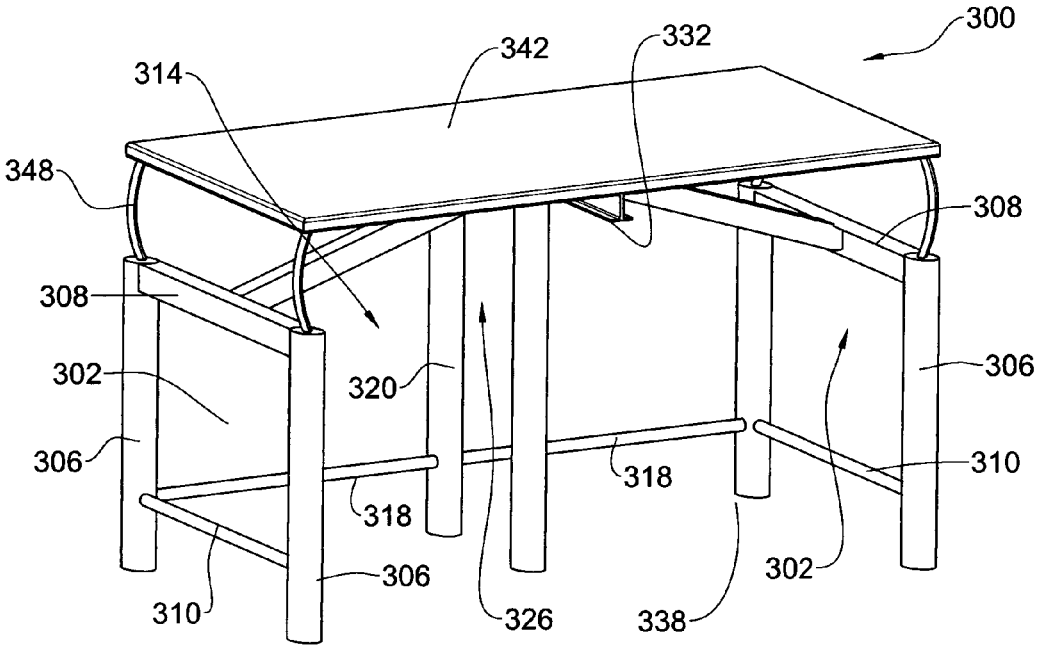
FIGS. 9A and 9B are a front and a rear perspective view, respectively, of still a configuration of a table in accordance with the presently disclosed subject matter.
Figure 9B:
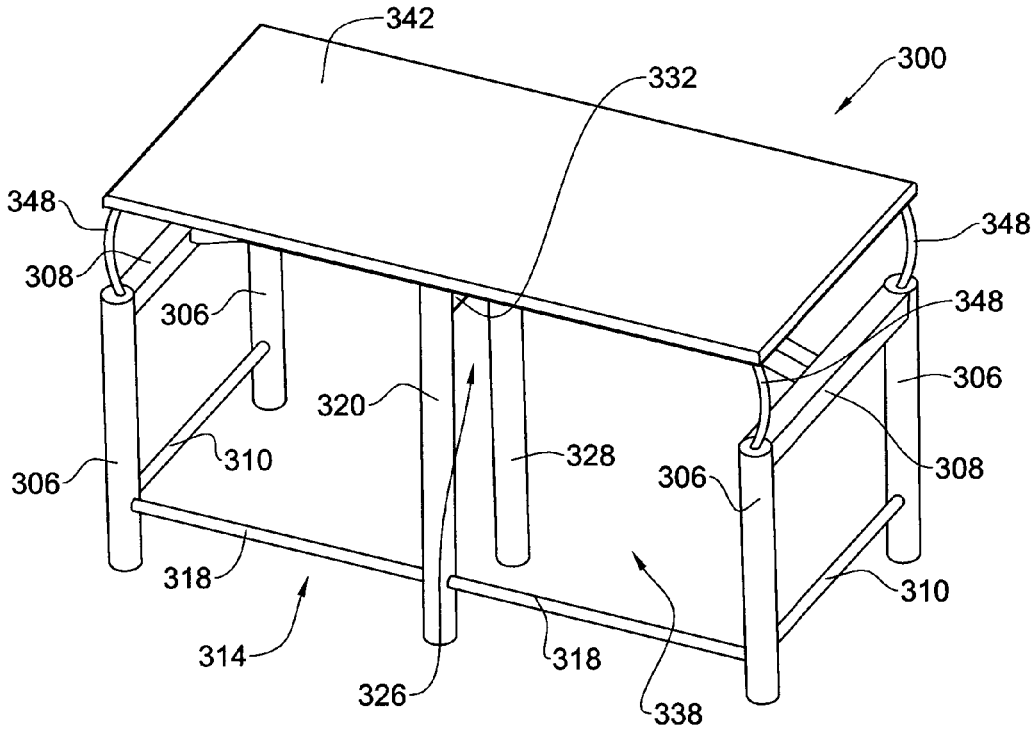

Yet another example is illustrated in FIGS. 9A and 9B illustrating a table in accordance with the presently disclosed subject matter and generally designated 300. Each of the side frames 302 is configured apart from the vertical load-bearing posts 306 and the horizontally extending bar 308 also with a lower interconnecting cross bar 310 (which is typically of a lesser moment of inertia as it is not intended to bear substantial loads, as opposed to the vertically extending post 306) and further, the rear frame 314 comprises a connecting bar 318 interconnecting between the posts 306 of the side frame 302 and the rear central post 320 constituting part of the central load-bearing assembly 326, the latter further comprising a central support post 328 and a substantially horizontally extending support beam 332 extending from the rear support column 320 towards the front edge of the table, and over the central support post 328. It is noted, as like in the previous examples that the front of the table is not obstructed by any bars or beams to thus facilitate comfortable occupation of individuals by the table at its functional state as a table and yet facilitate easy entrance into the safe space 338 extending under the table at the event of disaster.

The table top 342 is supported horizontally over the transversing support beam 332 of the central load-bearing assembly 326 and its side edges are supported by respective support elements 348 which in the present example are bode to thereby facilitate their plastic deformation at the event of vertical impact applied over the top surface 342.

Figure 10:
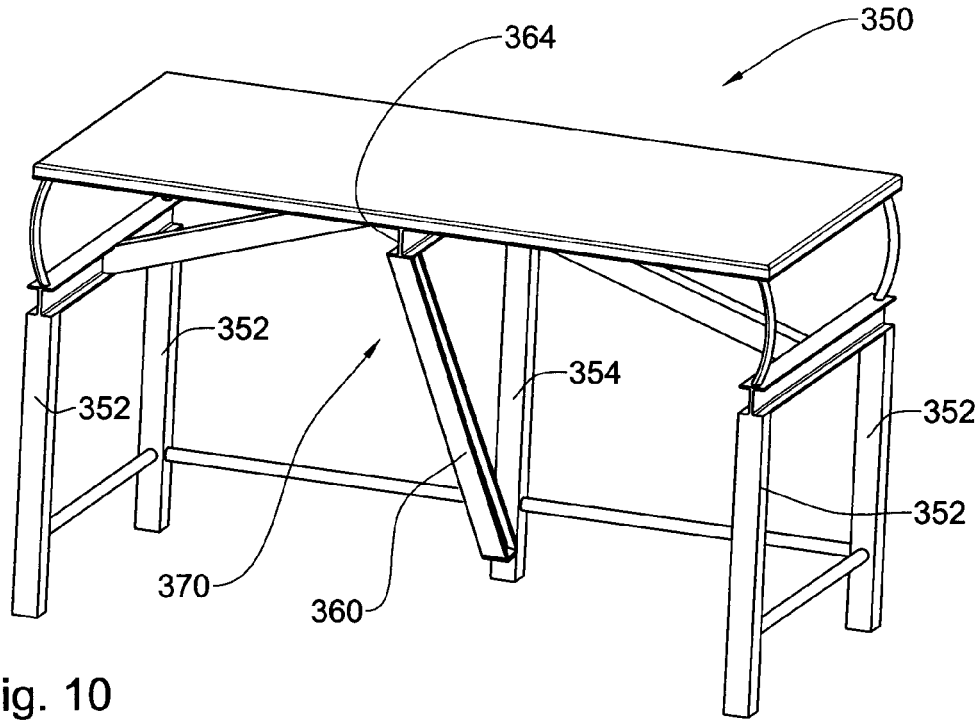
FIG. 10 is a perspective view of yet a table in accordance with the presently disclosed subject matter.

The example of FIG. 10 illustrates a table generally designated 350 resembling table 300 of FIGS. 9A and 9B however with two differences namely the cross-section of the vertically extending support beams 352, 354 is a rectangle as opposed to circular in the previous example and further, rather than a vertical central post 328 in FIGS. 9A and 9B there is here provided a diagonal support beam 360 extending from near a front end of the horizontal support beam 364 towards a lower end of the rear central post 354, constituting together a triangle-like shaped central load-bearing assembly generally designated 370.

Figure 11A:
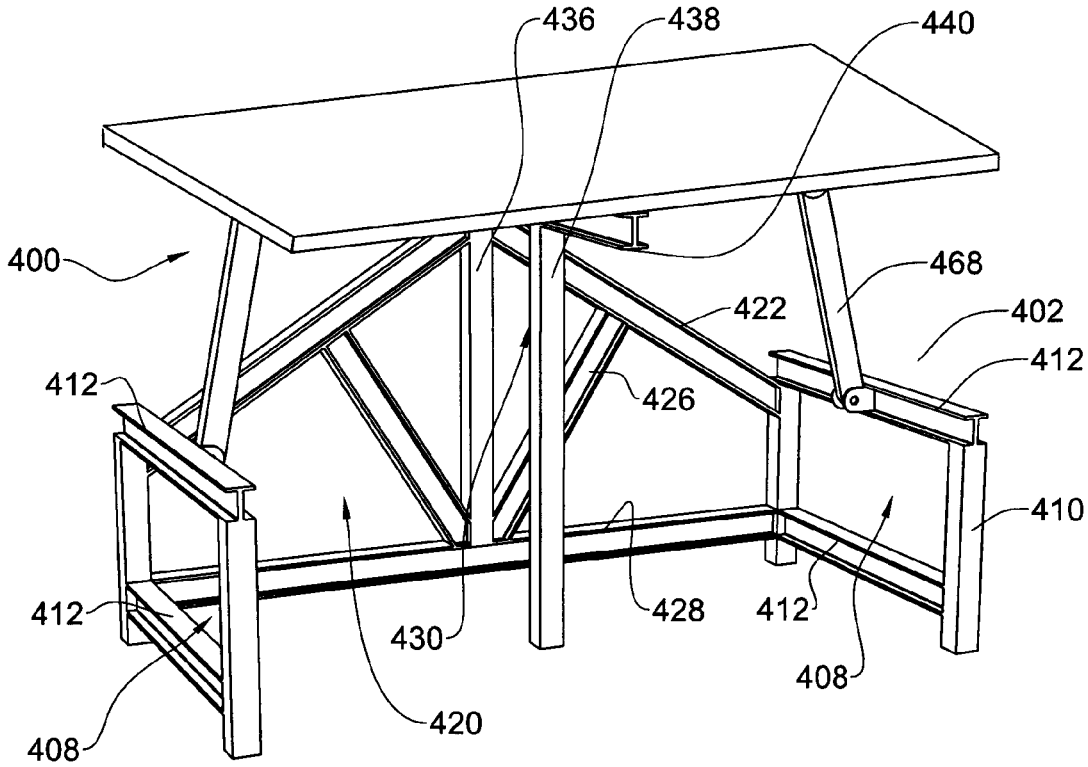
FIGS. 11A and 11B are a top and bottom perspective view of a table in accordance with a different design of a structure table in accordance with the presently disclosed subject matter.
Figure 11B:
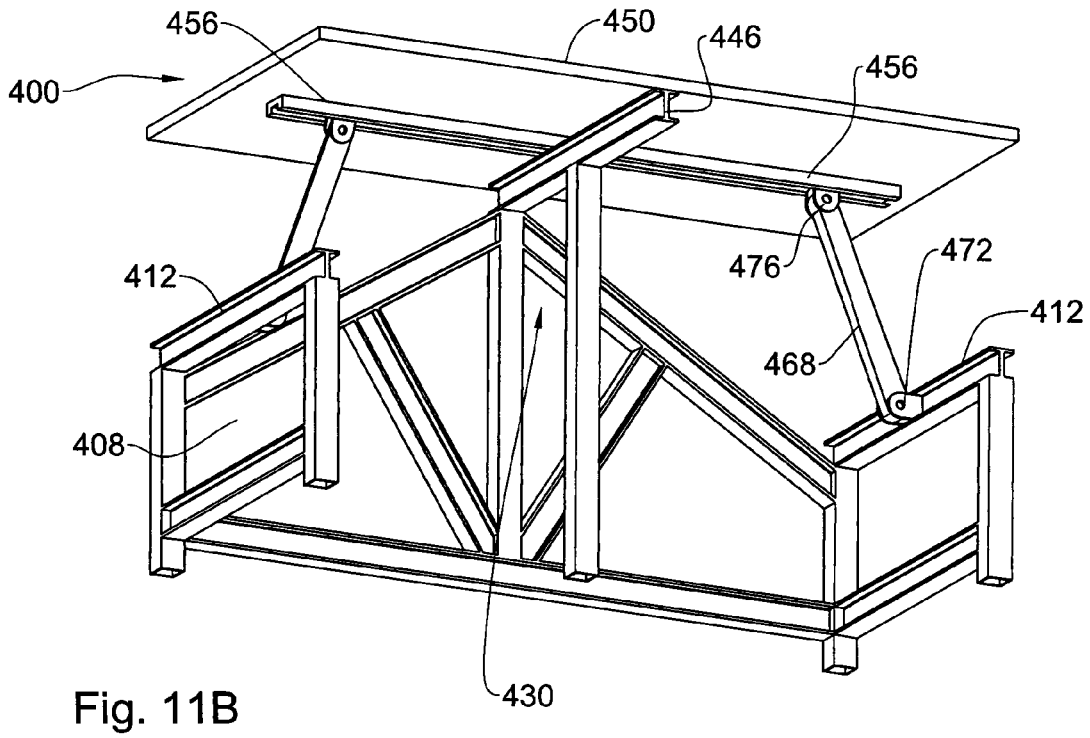
Figure 11C:
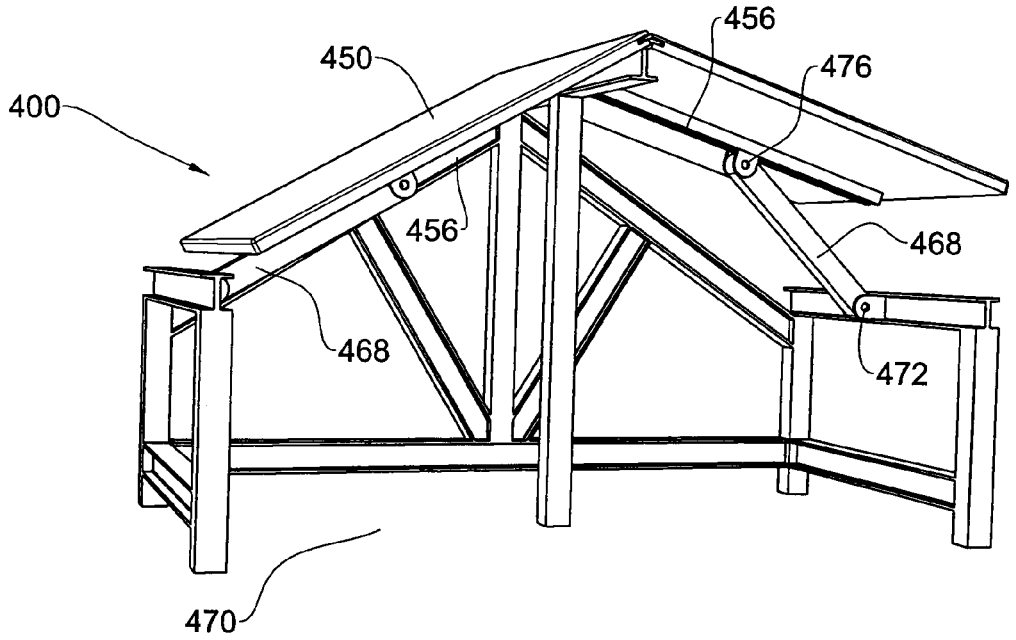
FIG. 11C illustrates the deformation of the table illustrated in FIGS. 11A and 11B upon applying impact over a top surface thereof.

FIGS. 11A to 11C illustrate a table generally designated 400 representing a modification of the presently disclosed subject matter. The cage-like reinforced support truss generally designated at 402 is made out of significantly reinforced beams, comprising side frames 408 made of rectangle vertically extending support beams 410 and i-like shaped cross-beams 412 (top and bottom beams). The rear frame 420 is also composed of i-like frames 422, 426 and 428 and the central load-bearing assembly designated at 430 is composed of rectangular vertical supports 436 and 438 and an interconnecting horizontally extending support beam 440 having an I-like cross-section which, as can be seen in the figures is received within a pre-formed slot 446 of the table top 450 (however it is appreciated that in accordance with an embodiment of this example, the support beam 440 may be molded within the table top in the case of a plastic or other molded table top).

As can further be seen best in FIGS. 11B and 11C, the table top 450 is supported from below over a support rail 456 extending substantially the entire length of the table top, and centrally oriented, however typically not constituting a continuous bar along the table top. Extending from the top bars 412 of the side frames 408 there is a table top support mechanism in the form of a sliding support element 468 pivotally linked at its lower end 472 to the horizontally extending support beam 412 and at its top end 476 being slidingly received within rail 456 and configured for displacement along the rail 456 in a fashion facilitating collapsing of the table top 450 (FIG. 11C) in a dampening fashion into a position wherein the rail 456 comes to rest over the support element 468 preventing further collapse of the table top into the safe space 470 defined by the cage-like support truss, the central load-bearing assembly 430 and the table top 450 resting over the rails 456 and support elements 468.

It is further realized that displacement of the top end 476 of support element 468 within rail 456 may be dampened by friction elements, mechanical obstacles, dampening mechanisms, e.g. hydraulic or otherwise dampened pistons, and the like.

Figure 12A:
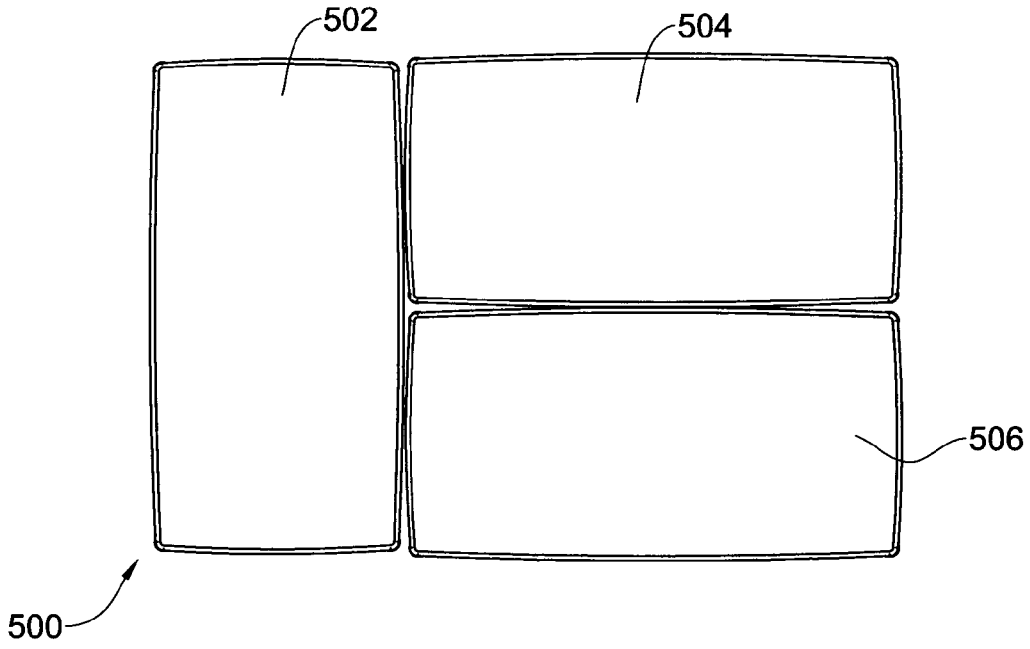
FIGS. 12A and 12B are a top and perspective view, respectively, of an array of support structures in accordance with the presently disclosed subject matter defining together a safe space.
Figure 12B:
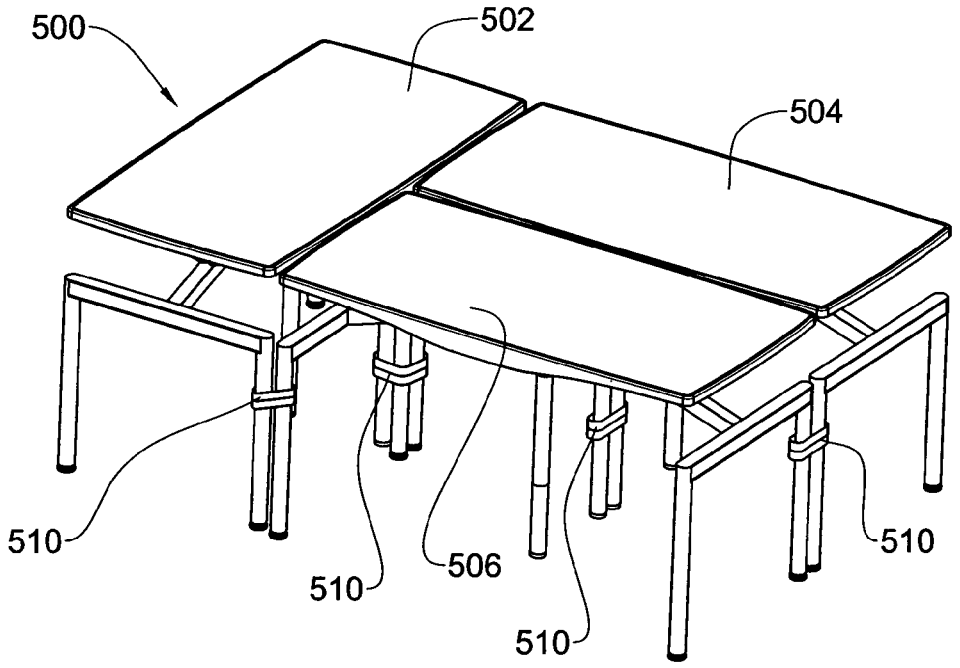

FIGS. 12A and 12B illustrate an array of three tables generally designated 500 and composed in the present example of three impact resistant tables in accordance with the present disclosed subject matter, designated 502, 504 and 506, respectively, giving rise together to a safe space of increased area suitable for sheltering several individuals. The tables may be positioned adjacent one another freely or secured to one another, e.g. by the provision of leg-binding assembly schematically illustrated at 510 e.g. mechanic cuffs, or other fasteners.

Figure 13:
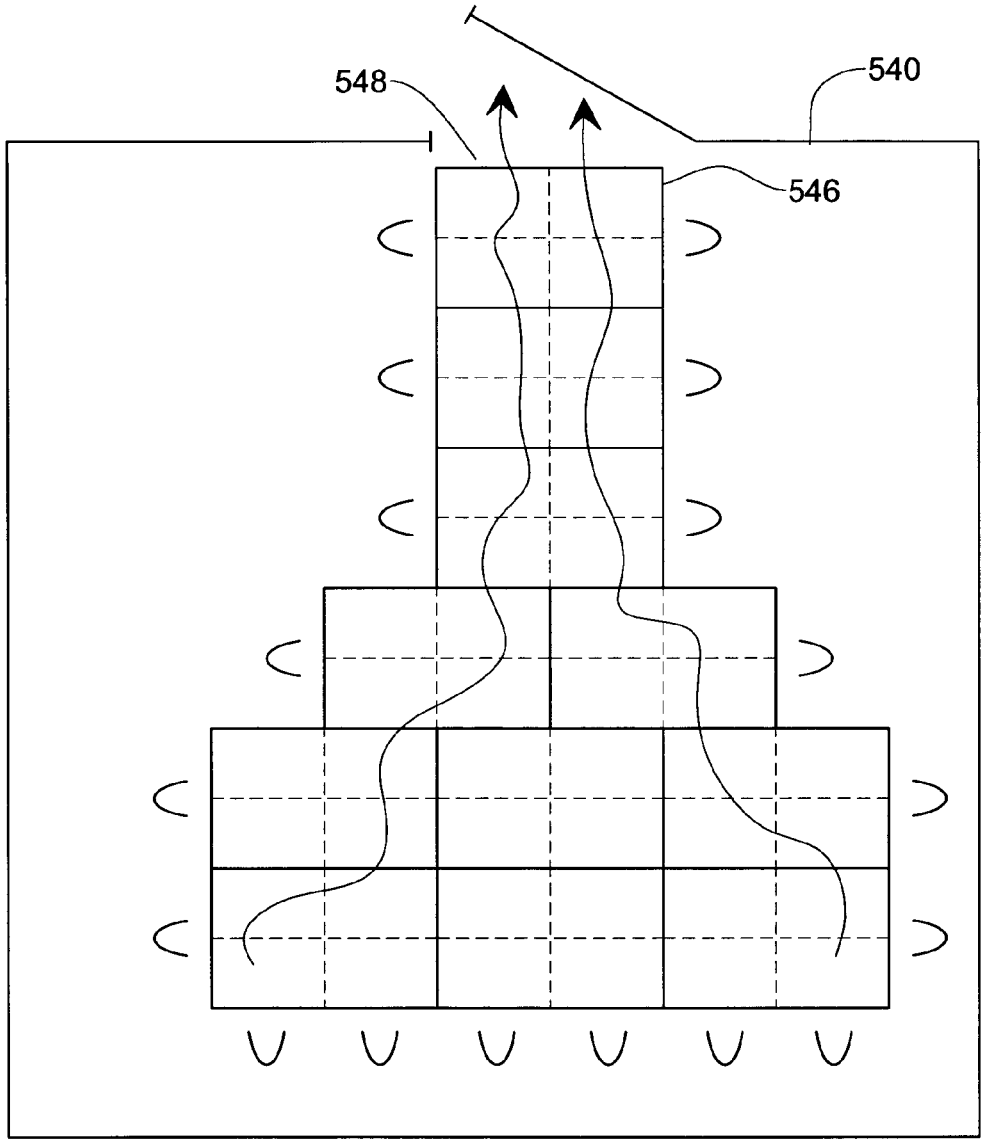
FIG. 13 is a schematic top view illustrating a room fitted with an array of support structures in accordance with the presently disclosed subject matter configured to define a safe space and a safe rescue path leading towards an exit from the room.

In FIG. 13 there is illustrated a schematic top view of a class room 540 or other space accommodating a plurality of tables 546, each in accordance with the present disclosed subject matter, which together define a large shelter space capable of sheltering a plurality of individuals and further, positioned so as to form a safe path leading towards a door or escape opening 548 formed in the class or space 540, thus enabling the individuals sheltered under the safe structure to escape from the class.

Figure 14:
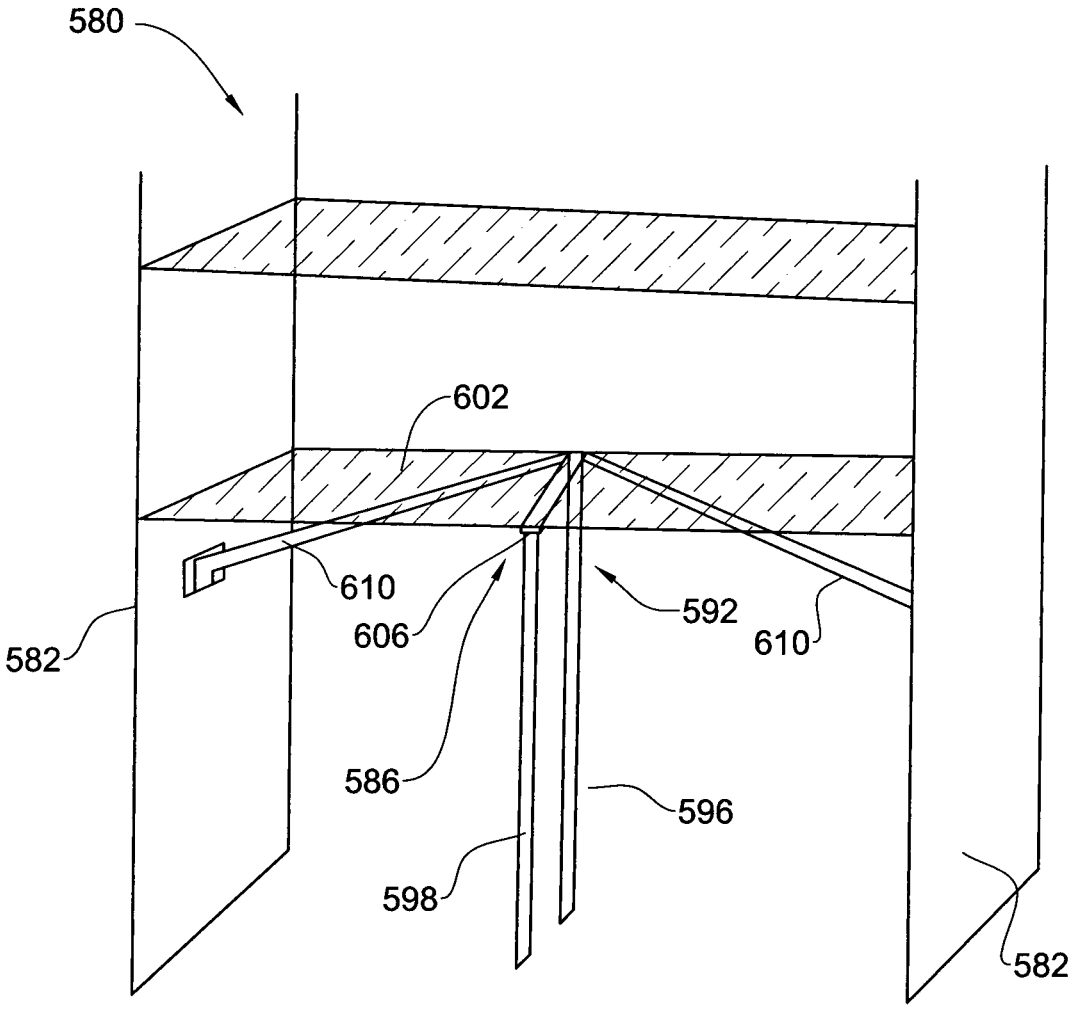
FIG. 14 illustrates a shelf structure configured in accordance with the principles of the presently disclosed subject matter.

FIG. 14 is an example of a different impact-resistant structure, a shelving system generally designated 580 comprising a pair of side walls 582 constituting the cage-like reinforced support truss with a central load-bearing assembly 586 in the form of a central partition 592 composed of several support beams 596 and 598, with a top shelf 602 extending over the vertical support beam 606 of the central load-bearing assembly 586 and towards the side walls 582 of the support truss, and further supported by inclining support beams 610 extending from a rearmost top end of the central load-bearing assembly 586 towards a central, however lower portion of the side walls 582.

Figure 15A:
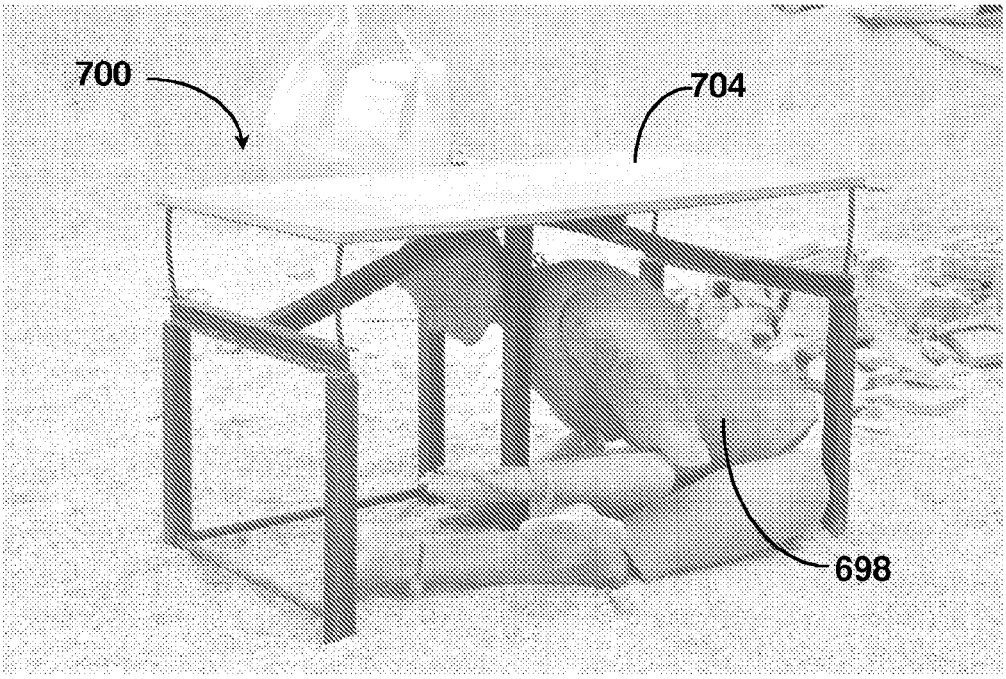
FIG. 15A illustrates a table in accordance with the presently disclosed subject matter with an individual dummy fitted below within the safe space.
Figure 15B:
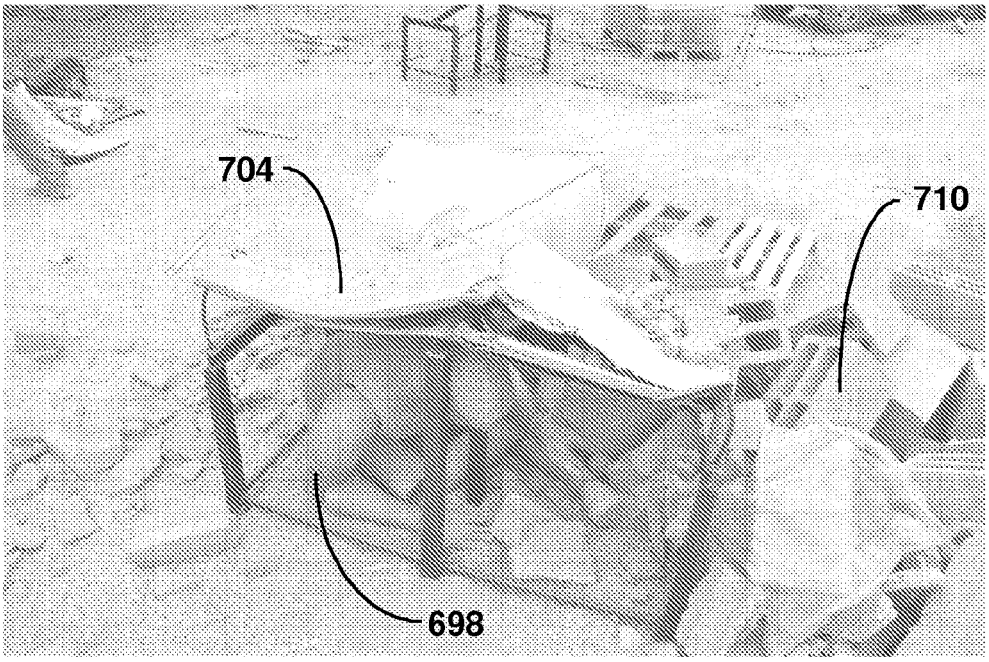
FIG. 15B illustrates the table of 15A resisting impact applied thereto.

FIGS. 15A and 15B illustrate the situation before and after an impact applied over a impact-resistant structure in accordance with the present disclosed subject matter. In FIG. 15A a dummy 699 representing an individual seeking shelter under a table 700 in accordance with the present disclosed subject matter is illustrated, prior to discharging a heavy load over the top surface 704 of the table. In FIG. 15B a heavy load composed of bricks has been discharged over the table top 704 and as illustrated, the table top has collapsed however the safe space accommodating the dummy remains unpacked, and it is further noticed that the top surface 704 has collapsed inclining downwards such that the debris (building bricks 710) will tend to slide off the top surface and the dummy 699 representing a live individual is substantially unhurt.

Referring now to FIGS. 16A to 16F, there is shown a table, generally designated 800, constructed and operative in accordance with a further embodiment of the disclosed subject matter. Table 800 is substantially the same as the tables of the previous embodiments, and includes a table top 810 configured with a lattice-like support frame 844 (best seen in FIG. 16D) supporting the tabletop from below and increasing the rigidity thereof and configured for supporting the table top upon its collapsing. The table top 810 is mounted on over a load-bearing assembly 812, two side frames 814, and a rear frame 816. Side frames 814 and a rear frame 816 are substantially the same as side frames 302 and rear frame 314 of FIGS. 9A and 9B, respectively, and may be made of any rigid material, such as metal, plastic, wood, etc or a combination thereof.

Load-bearing assembly 812 includes a top beam 820, bearing table top 810, substantially at the middle of its length, and a first and second pairs of downwardly extending frame members 822, and 824 sloping from the top beam 820, towards the upper end side frames 814. According to this embodiment, first frame members 822 are affixed to top beam 820, substantially at one end thereof, in close approximation to rear frame 816, and second frame members 824 are affixed to top beam 820, substantially at the center thereof. This deployment precludes possible rolling over of table 800, in case a weighted mass falls only on one side of table top 810, by equally absorbing the shock.

Figure 1B:
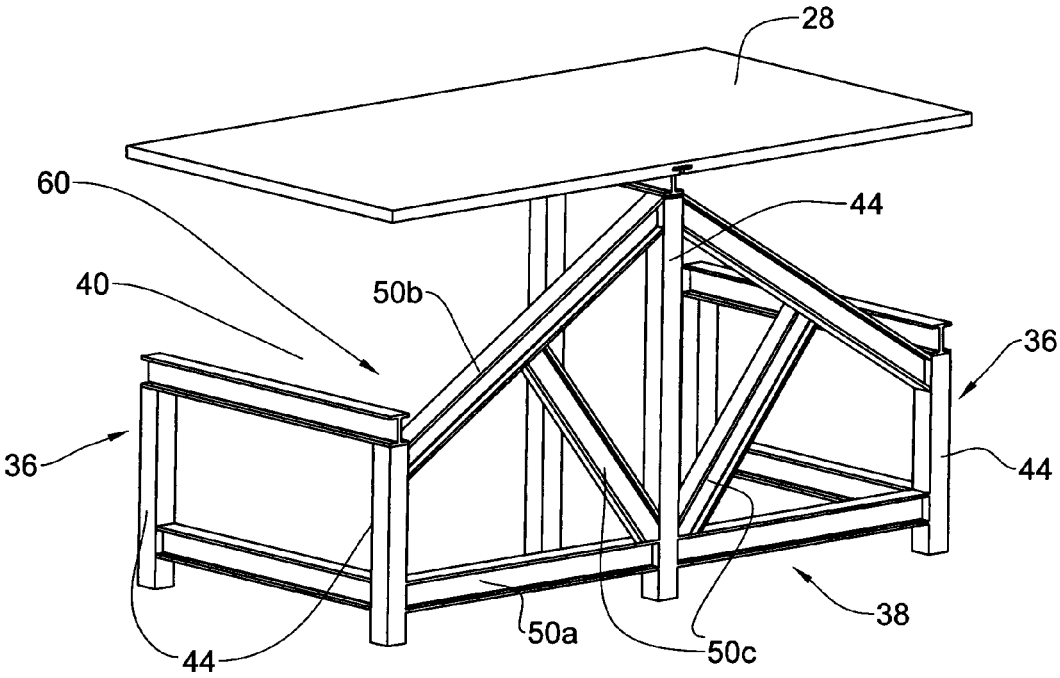
FIG. 1B is a rear perspective view of the table seen in FIG. 1A.
Figure 1C:
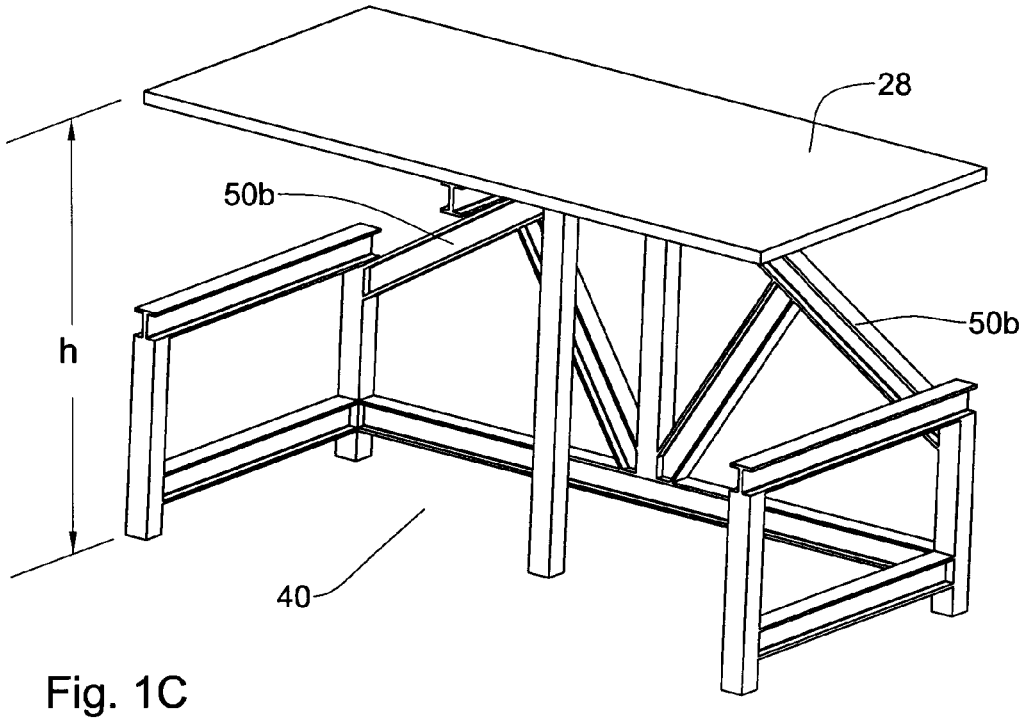
FIG. 1C is a front perspective view of the table seen in FIG. 1A.
Figure 1D:
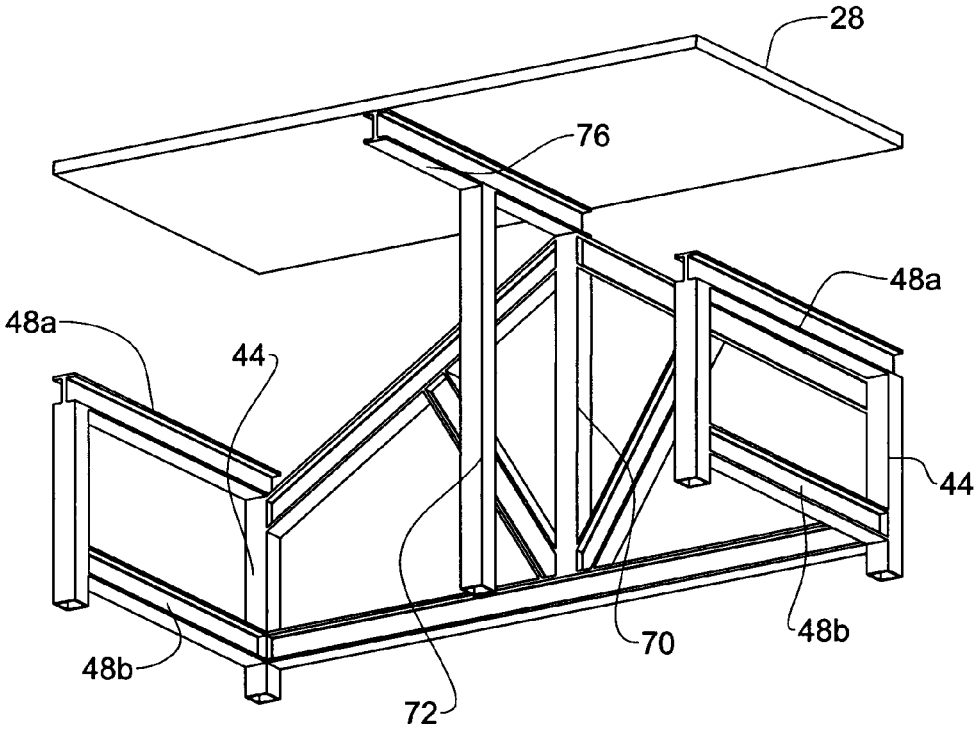
FIG. 1D is a front bottom perspective view of the table seen in FIG. 1A.

Top beam 820, is supported by a vertical post 825, which is similar to post 72 of FIGS. 1A-1C. However, according to this embodiment, vertical post is located close to the front of the table, and not at its center, thereby providing additional stability. In this configuration, vertical post 825 prevents table 800 from rolling over in the event that the load falls unevenly over the table top 810 and hits the front edge thereof. In addition, vertical post 825 may be coupled to rear frame 816 by means of a horizontal bar 830, thus providing table 800 additional stability.

It will be appreciated that vertical post 825 may be positioned anywhere along the length of top beam 820, between the center of the table and its front. It will be further appreciated that vertical post 825 may be positioned slightly away from the front of the table, so as to form a front opening without any obstacles, allowing students using the table to sit anywhere along the front of the table 800. In accordance with one example, the relative orientation of the vertical post 825 relative the center of the table top 820 may be 1:3, namely the vertical post is positioned inwards approximately one quarter of the width from the front edge of the table and distanced from the rear edge, approximately three quarters of the width.

Table 800 further includes one or more (four in the present example) shock absorbing support elements (SASE), generally designated 835, mounted substantially at the ends thereof, for absorbing some of the shock caused when a weighted mass falls on the table top causing it to collapse.

The shock absorbing elements (SASE) 835 are coupled to the top of each of the side frames 814, on one side and coupled to table top 810 support frame 844 on the other side. Alternatively, shock absorbing elements 835 may be coupled to first and/or second frame members 822, and 824, and may or may not be coupled to the table top 810 and/or its support frame.

Shock absorbing elements 835 may be configured to absorb a substantial amount of force caused by the collapse of table top 810, thus, the side frame 814 and other frame members can be formed with material of a lesser moment of inertia, than otherwise would be required to withstand the collapse.

Figure 16A:
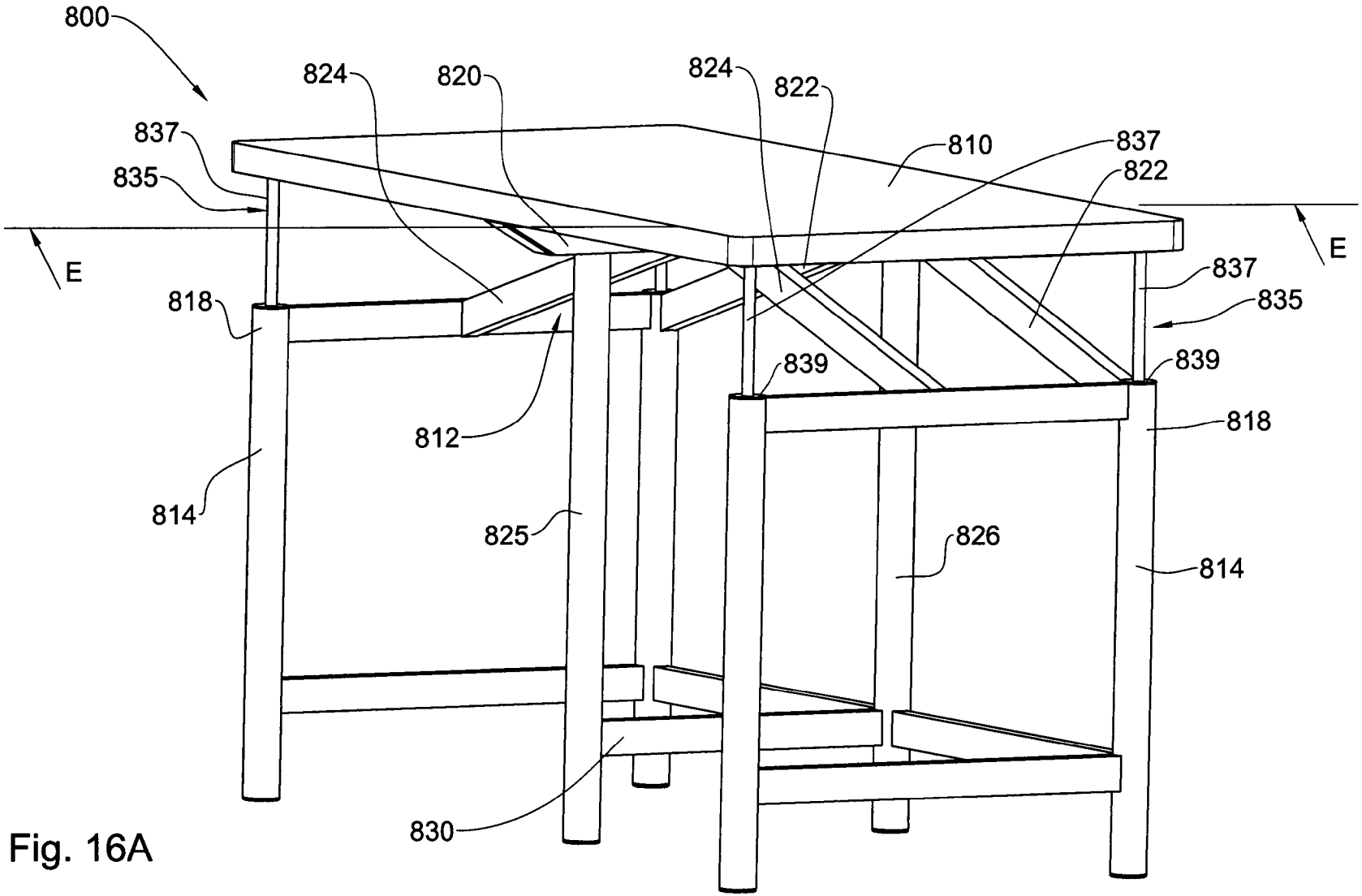
FIG. 16A is a side perspective view of a table in accordance with another configuration of the disclosed subject matter.
Figure 16B:
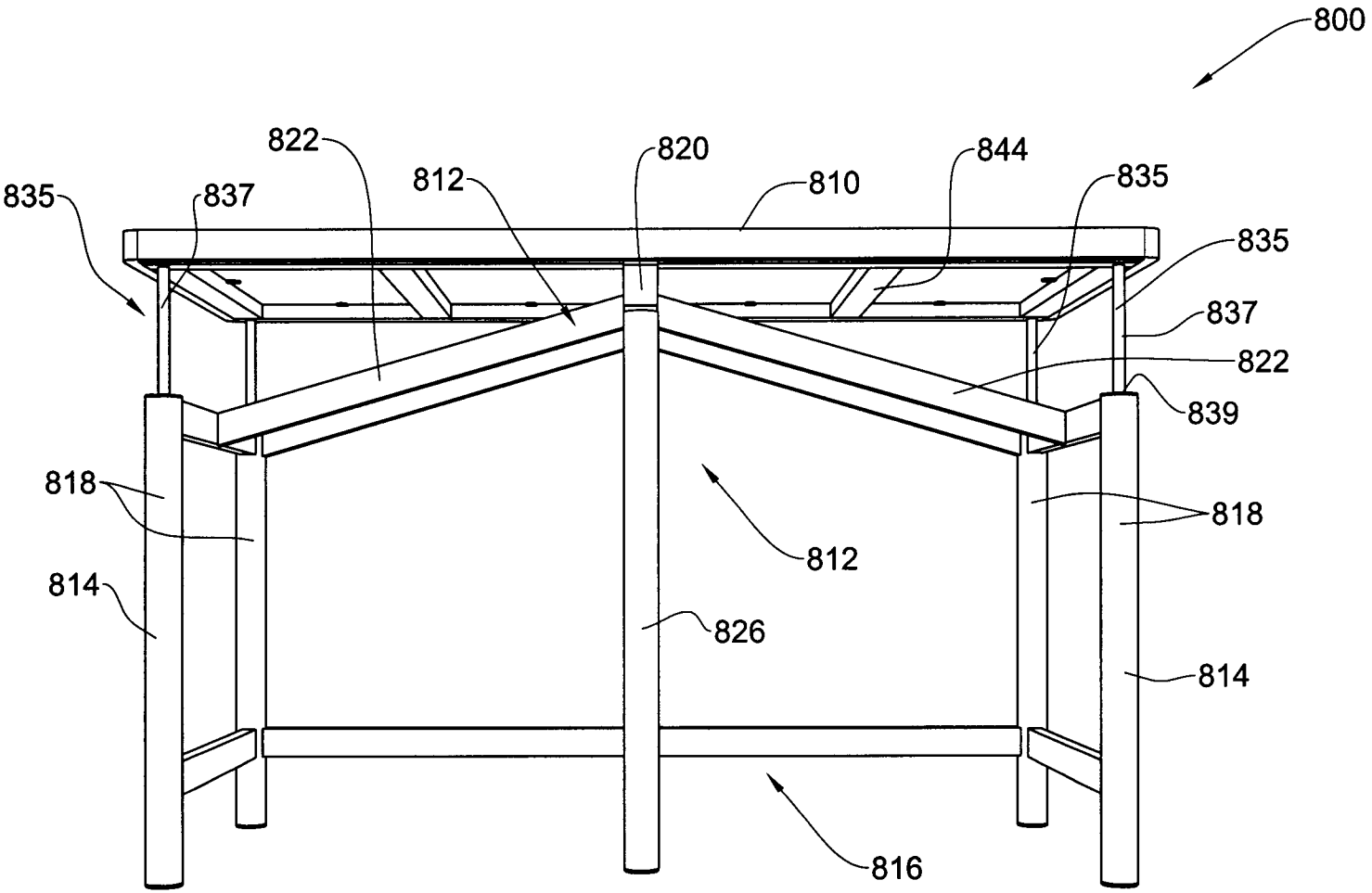
FIG. 16B is a side view of the table of FIG. 16A.
Figure 16C:
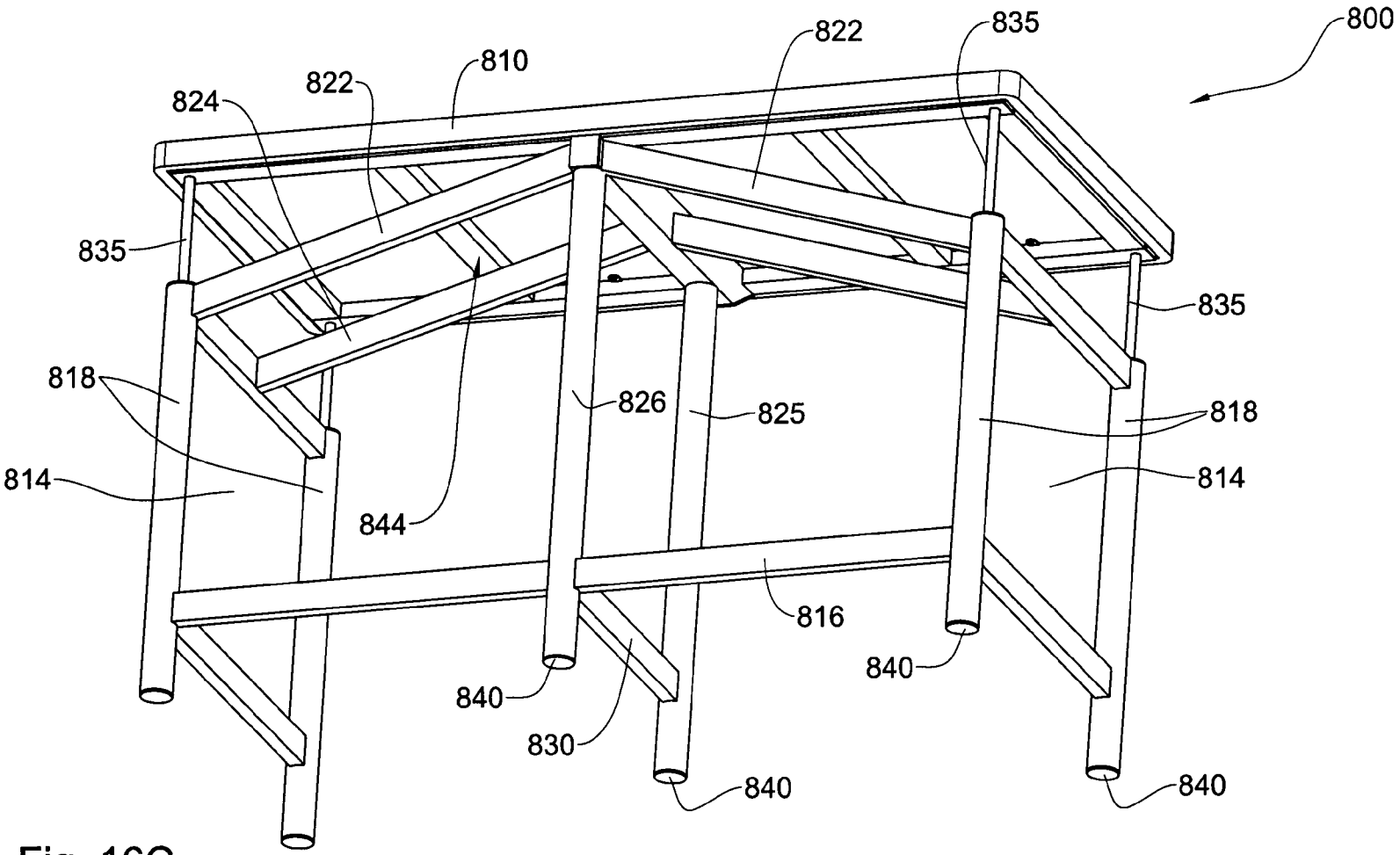
FIG. 16C is a bottom perspective view of the table of FIG. 16A.
Figure 16D:
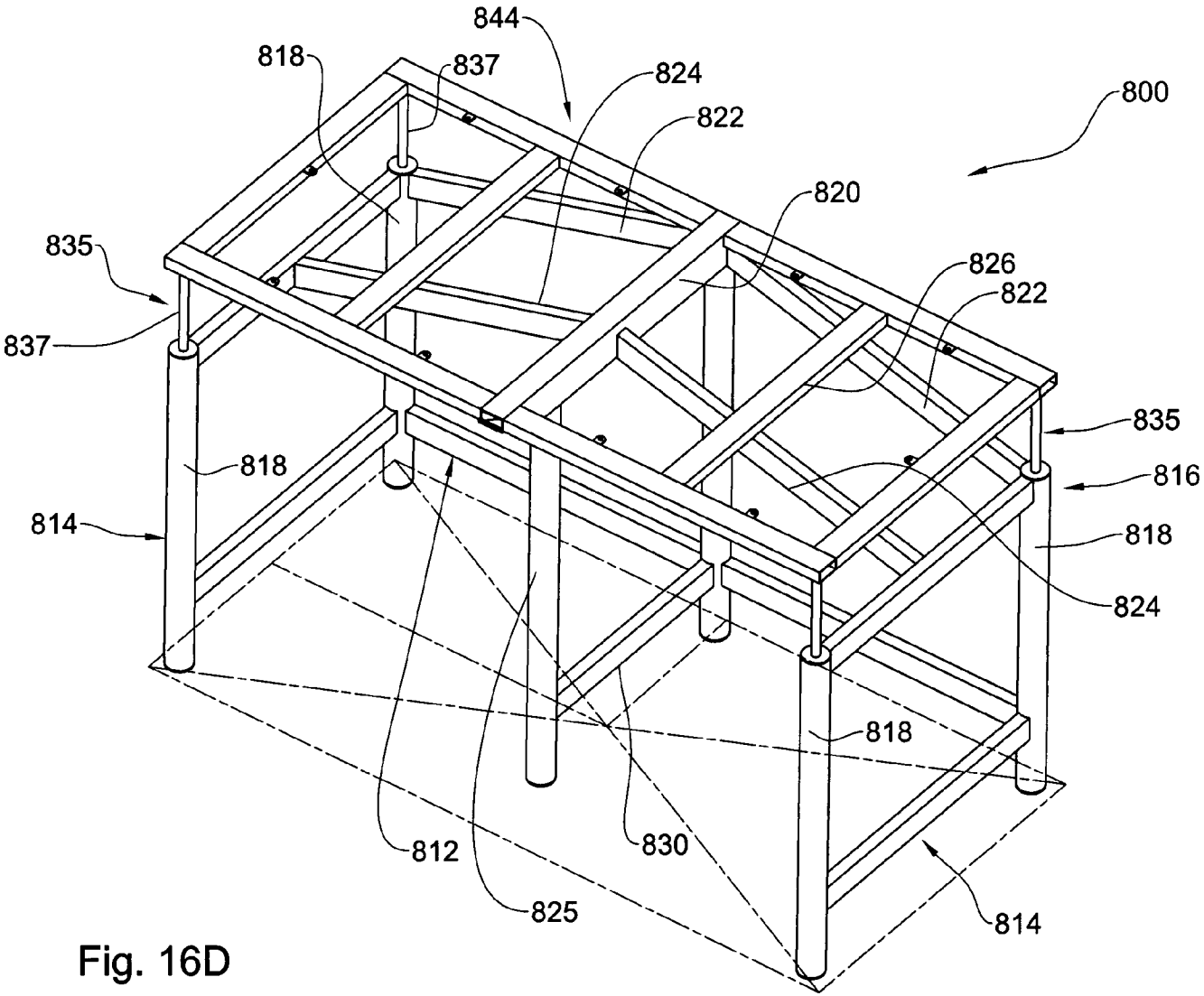
FIG. 16D is a top perspective view of the table of FIG. 16A, devoid of the tabletop.
Figure 16E:
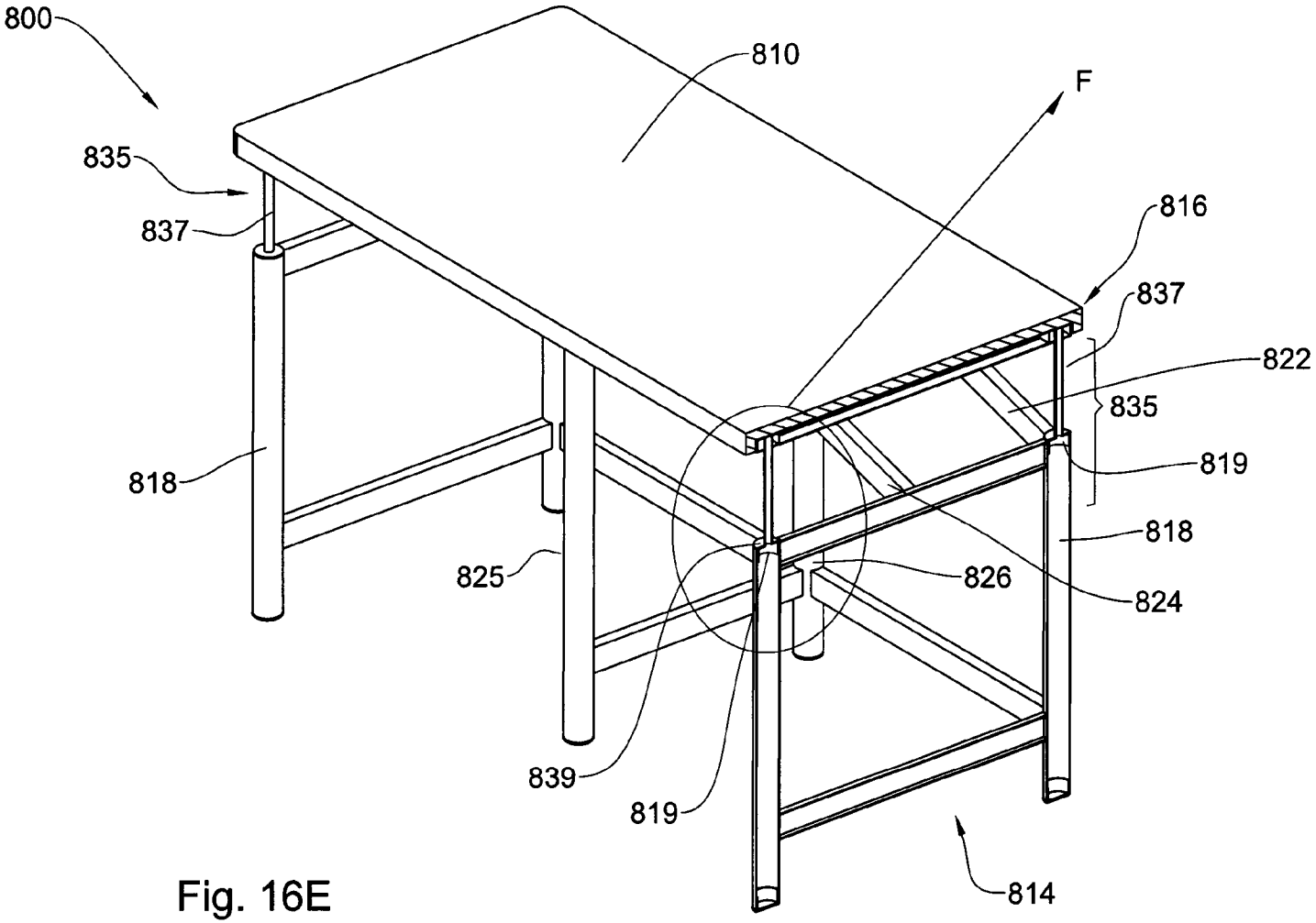
FIG. 16E is a sectioned view of the table, taken along line E-E in FIG. 16A.
Figure 16F:
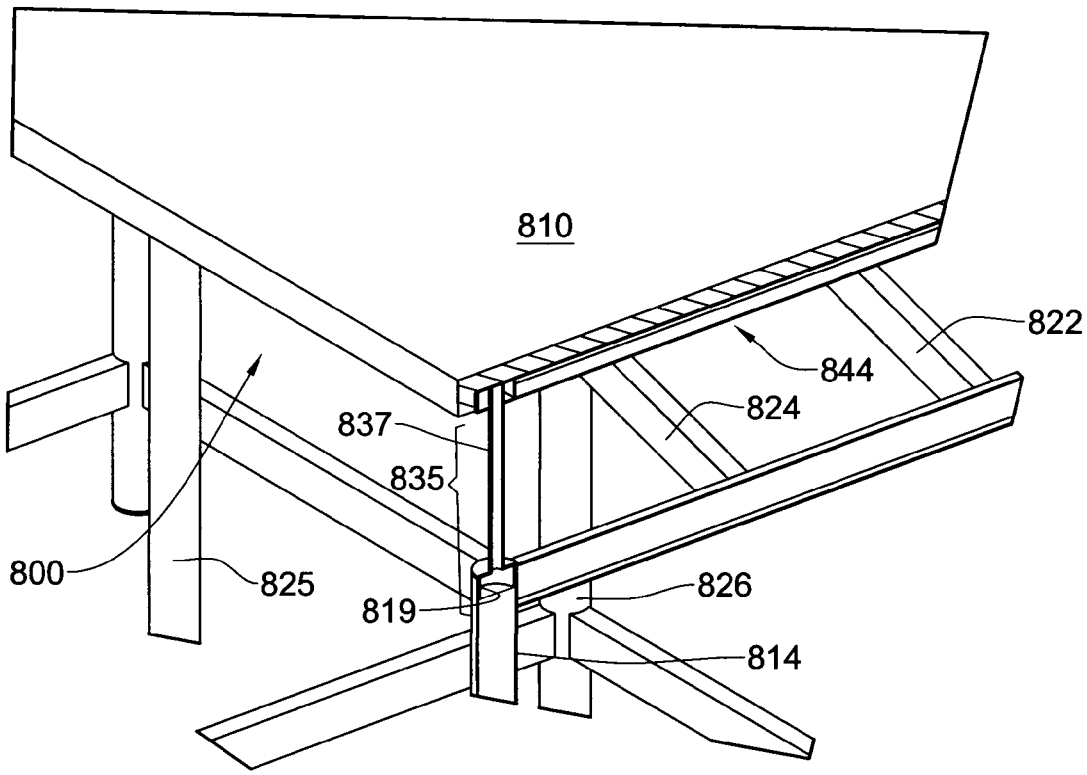
FIG. 16F is an enlargement of the portion marked F in FIG. 16E.
Figure 16G:
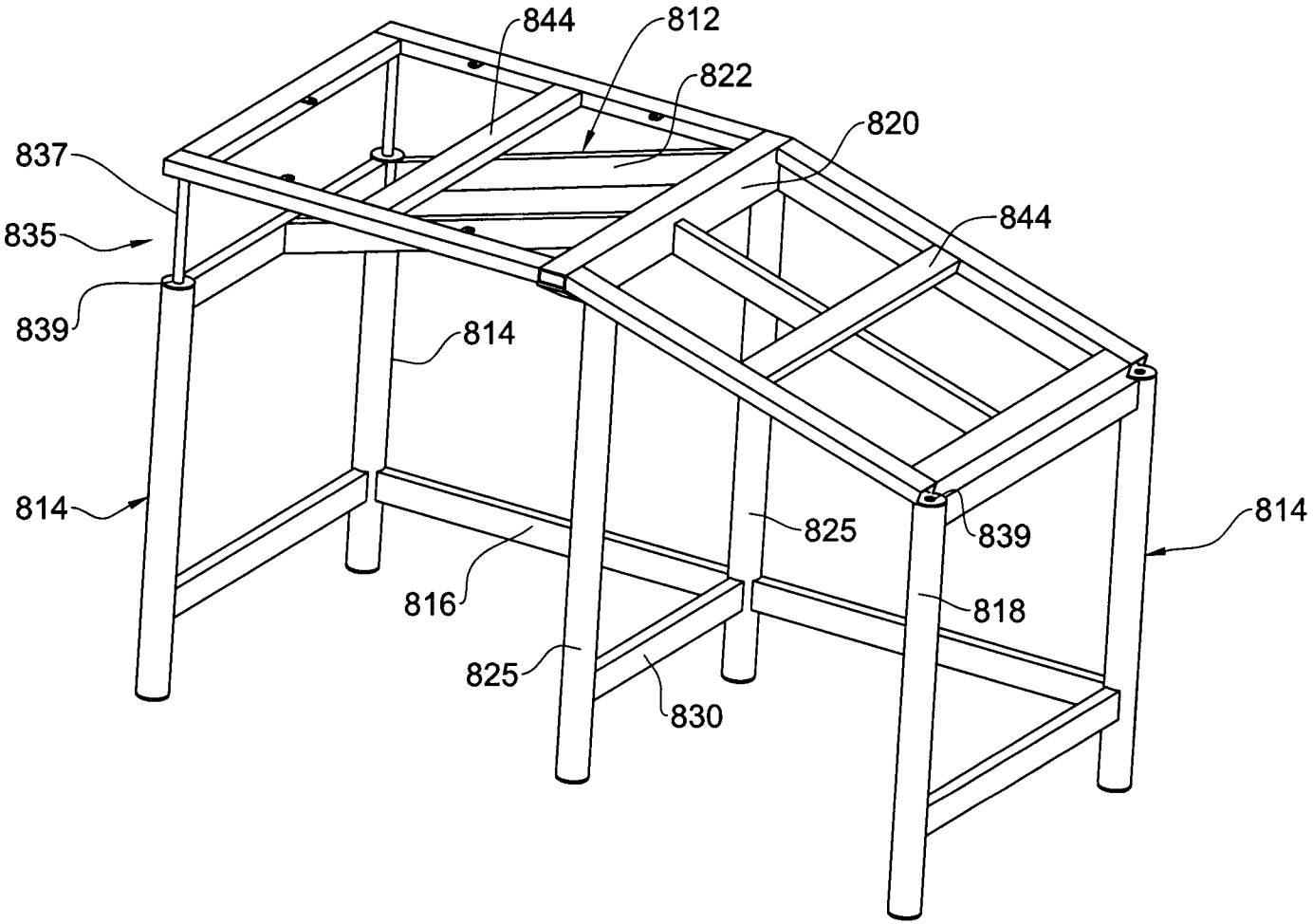
FIG. 16G is a top perspective view of the table of FIG. 16A, devoid of the tabletop and schematically illustrating the deformation of the table following application of impact over one side of a top surface thereof.

According to the illustrated example, and as can best be seen in FIGS. 16E and 16F, shock absorbing element (SASE) 835 is in the form of a piston rod 837 vertically mounted on top of side frame 814. Side frame 814, according to this example, includes two, at least partially hollow at the top end vertical side bars 818 constituting piston cylinders, at each side of the table, with a piston element 819 fixed at a bottom end of the piston rod 837 and slidingly received within the piston cylinder. Piston rod 837 having a smaller section than side bars 818, is configured to telescopically slide inside the hollow portion under impact shock. The piston rod 837 may be mounted on top of side bar 818, in any known fashion, such as welding, soldering etc. In accordance with the illustrated example, the rod 837 is articulated to the top end of the bar 818 through a washer-like element 839. It will be appreciated that other configurations are also envisioned, e,g. the rod 837 may be articulated to the side bar 818 through a plug, such that in order to allow rod 837 to slide inside side bar 818 in the event of an impact on and the collapse of table top 810, the joint or articulation therebetween is configured to break (as seen in FIG. 16G). Thus, the joint between rod 837 and side bar 818 is configured to withstand normal forces caused by normal use of the table, and to break when extraordinary forces are applied to the table top 810.

It will be appreciated that rod 837 may be configured to displace in other ways relative to side bars 818, in case of a collapse of table top 810. For example, rod 837 can be hollow and can include a section larger than the section of side bars 818, in such a way which allows rod 837 to slide downwardly, while side bar 818 enters the hollow section inside rod 837, thus substantially absorbing the impact shock and energy.

According to another embodiment, shock absorbing elements 835 may be any type of buffer configured to absorb energy and/or shock. Such a buffer may for example be a piston, e.g. mechanical, pneumatic or hydraulic piston, configured to provide table top 810 stability under the influence of forces caused by a normal use of the table, and to absorb extraordinarily momentum caused by the collapse of the table.

Table 800 further includes leg pads 840 mounted at the bottom of side bars 818 and vertical post 826 and 825, for precluding the displacement of table 800. This is particularly important when the forces applied on the table, are not applied evenly and perpendicular to the table top 810, thus causing the table to displace sidewardly. Leg pads 840, preclude or at least reduce these displacements, thus, allowing the table to provide a safe shelter to a person hiding underneath the table top. It will be appreciated that leg pads 840 may be made of any flexible material, such as silicone, plastic, rubber, wood, etc. The side bars 818 and vertical post 826 and 825 may further be configured with any type of buffer to reduce displacement and/or reduce the shock of the impact on the structure.

Figure 16H:
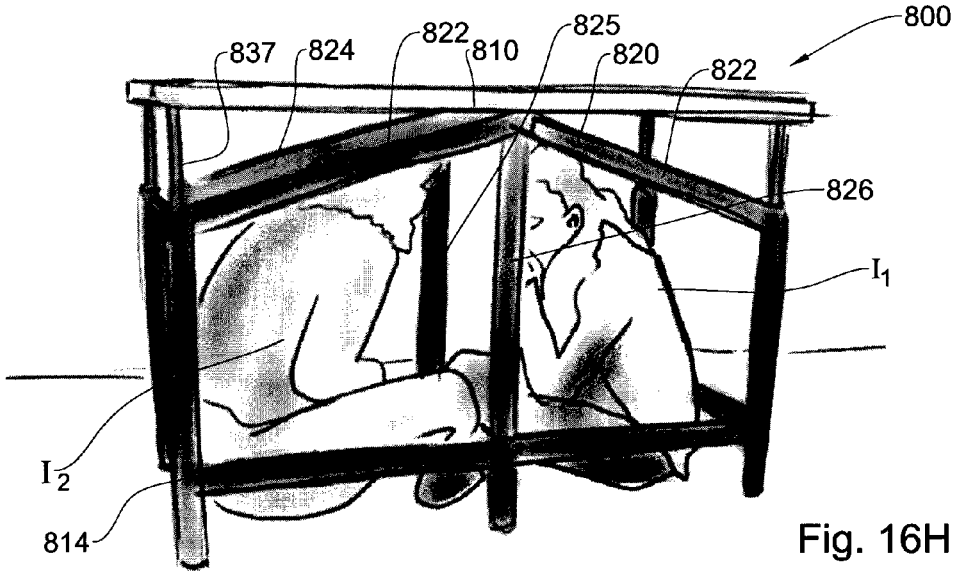
FIG. 16H illustrates a table in accordance with the presently disclosed subject (as seen e.g.
Figure 16I:
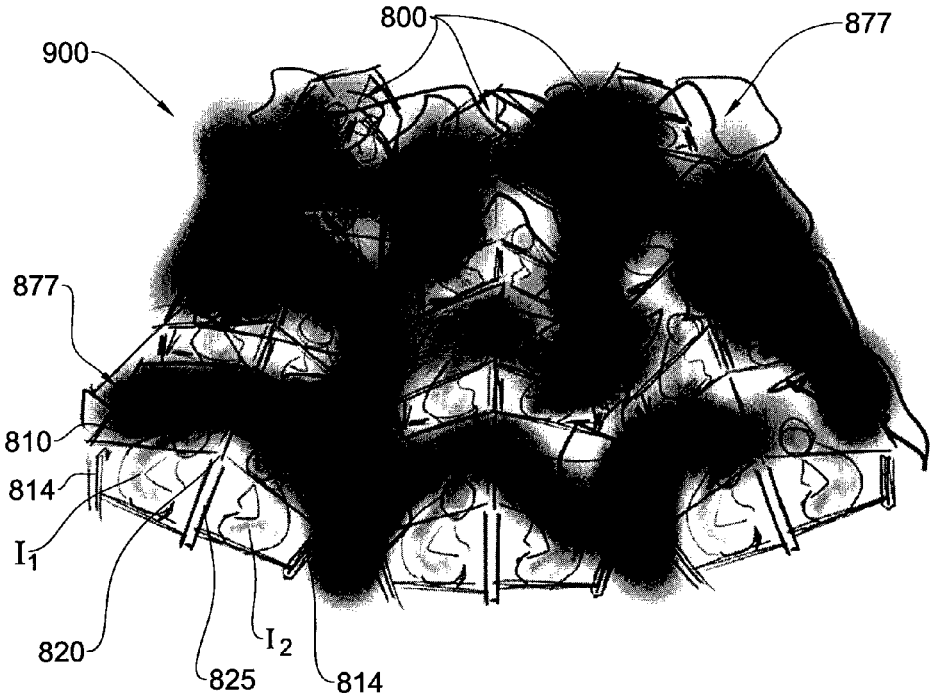
FIG. 16I illustrates an array of tables in accordance with the presently disclosed subject matter following an impact upon the table tops with two individuals fitted within the safe space in each of the tables.
Figure 17:
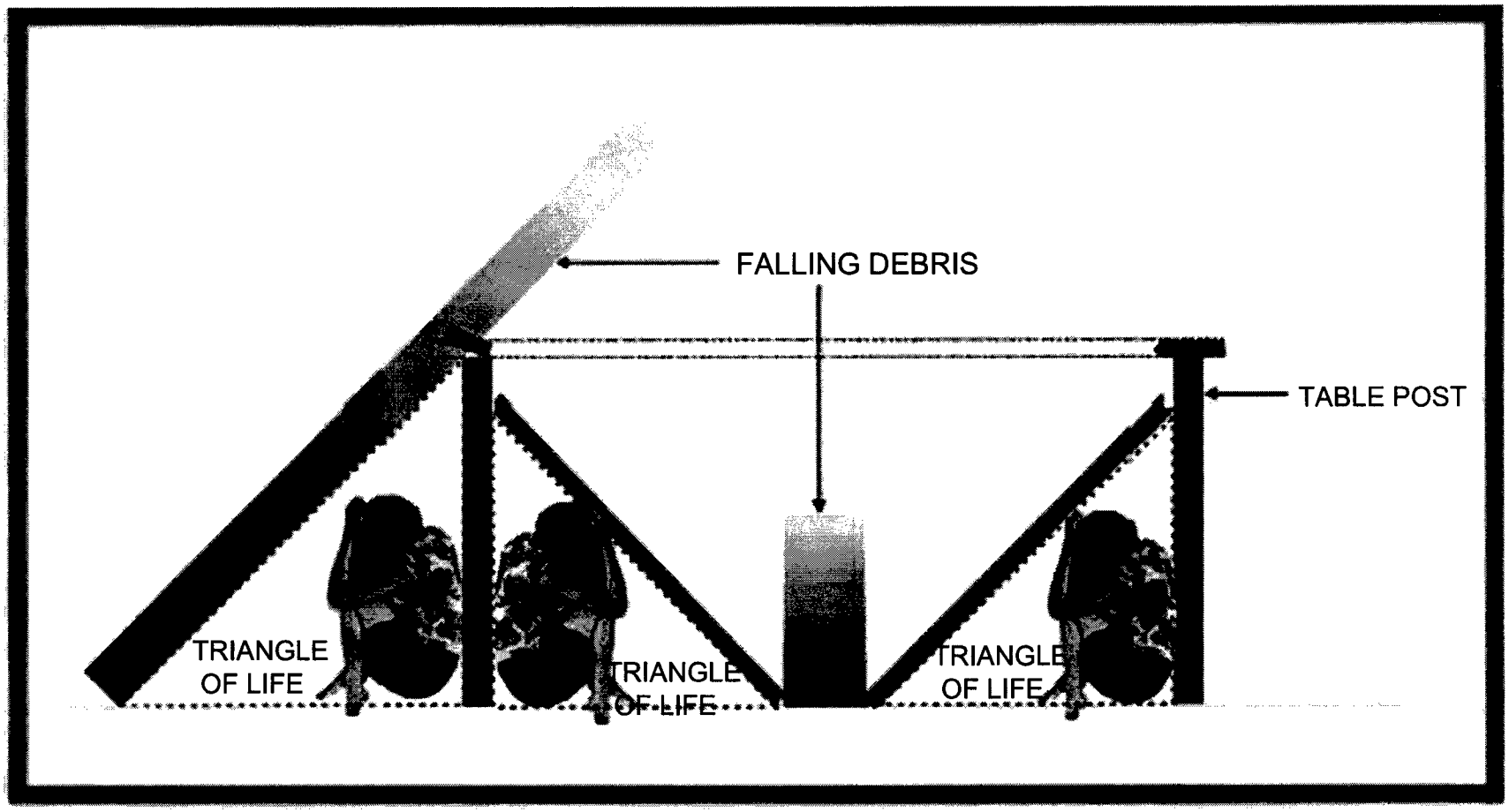
Fig. 17 ( Prior Art)
FIG. 17 is a prior art schematic illustration of formation of survival spaces following an earthquake.

FIG. 16H illustrates a table with two individuals I1 and I2 underneath the table 800 before an impact was applied over the impact-resistant structure in accordance with the present disclosed subject matter. In FIG. 16I a heavy load designated 877 composed of classroom ceiling portions has been discharged over the table top 810 and as illustrated, the table top has collapsed however the safe space accommodating the individuals I1 and I2 remains undisturbed, and it is further noticed that the top surface 810 has collapsed inclining downwards on both sides of the central load-bearing horizontal beam 820 such that the debris 877 will tend to slide off the top surface and the individuals I1 and I2 remain substantially unhurt.

The general concept in accordance with the present disclosed subject matter is such that the safe space defined by the cage-like reinforced support truss together with the central load-bearing assembly and the top surface provide for a safe space resistant to applied thereupon impacts and further, each side of the top surface is designed to allow its collapsing in one direction so as to form a slide for debris to fall off the top surface and reduce the load extending over the top surface at the event of catastrophe.

The invention claimed is:

1. An impact resistant structure, comprising:

a support truss including:

at least two side frames, each of the at least two side frames including at least two vertical members connected at an upper end thereof with a horizontal member; and a rear frame including at least one vertical frame post extending along substantially an entire length of the at least two vertical members and above a height of the at least two vertical members;

a load-bearing assembly including:

at least one vertical load-bearing post spaced apart from the at least one vertical frame post and having a height substantially corresponding to the height of the at least one vertical frame post;

at least one horizontal load-bearing beam extending at least between the at least one vertical load-bearing post and the at least one vertical frame post; and at least two inclined load-bearing beams substantially extending from the at least one horizontal load-bearing beam to the at least two side frames.

2. The impact resistant structure in accordance with claim 1, wherein the at least two side frames are further interconnected by a rear beam connecting two of the at least two vertical members on each of the at least two side frames through the at least one vertical frame post.

3. The impact resistant structure in accordance with claim 1, wherein the at least one horizontal load-bearing beam extends generally centrally between the at least two side frames.

4. The impact resistant structure in accordance with claim 1, wherein the at least one horizontal load-bearing beam extends generally centrally between the at least two side frames, and wherein at least one vertical load-bearing post is generally centered with respect to a length of the at least one horizontal load-bearing beam.

5. The impact resistant structure in accordance with claim 1, wherein at least one vertical load-bearing post is off centered with respect to a length of the at least one horizontal load-bearing beam.

6. The impact resistant structure in accordance with claim 1, wherein at least one vertical load-bearing post is positioned approximately ¾ of a length of the at least one horizontal load-bearing beam.

7. The impact resistant structure in accordance with claim 1, further comprising a horizontal support frame mounted over the impact resistant structure.

8. The impact resistant structure in accordance with claim 1, further comprising a horizontal support frame mounted over the impact resistant structure, and wherein the horizontal support frame is configured to support a top surface.

9. The impact resistant structure in accordance with claim 1, wherein the at least two inclined load-bearing beams extend substantially centrally from the at least one horizontal load-bearing beam to the at least two side frames.

10. The impact resistant structure in accordance with claim 1, further comprising four inclined load-bearing beams, two of the four inclined beams extending from at least one vertical frame post to the at least two side frames and two of the four inclined beams extending from the at least one horizontal load-bearing beam to the at least two side frames.

11. The impact resistant structure in accordance with claim 1, further comprising a substantially planar support frame extending on sides of a horizontal support beam.

12. The impact resistant structure in accordance with claim 11, further comprising impact absorbing members at top ends of at least two side members.

13. The impact resistant structure in accordance with claim 12, wherein the impact absorbing members are configured to support the substantially planar support frame.

14. The impact resistant structure in accordance with claim 1, wherein the impact absorbing members are shock absorbing support elements configured for absorbing at least some of the shock caused when a weighted mass falls on the impact resistant structure causing the impact resistant structure to collapse.

15. The impact resistant structure in accordance with claim 14, wherein the shock absorbing support elements are in a form of a piston.

16. The impact resistant structure in accordance with claim 1, further comprising a top surface leveled above the at least one horizontal load-bearing beam.

17. A desk, comprising:

an impact resistant structure including:

a support truss including:

at least two side frames, each of the at least two side frames including at least two vertical members connected at an upper end thereof with a horizontal member; and a rear frame comprising at least one vertical frame post extending along substantially an entire length of the at least two vertical members and above a height of the at least two vertical members;

a load-bearing assembly including:

at least one vertical load-bearing post spaced apart from the at least one vertical frame post and having a height substantially corresponding to the height of the at least one vertical frame post;

at least one horizontal load-bearing beam extending at least between the at least one vertical load-bearing post and the at least one vertical frame post; and at least two inclined load-bearing beams substantially extending from the at least one horizontal load-bearing beam to the at least two side frames; and a table top mounted over the impact resistant structure.

* * * * *